US012709961B2

(12) United States Patent
Arabskyy et al.

(10) Patent No.: US 12,709,961 B2
(45) Date of Patent: Aug. 18, 2026

(54) ACTUATION DEVICE FOR ACTUATING A TARGET SLEEVE VALVE ASSEMBLY, AND RELATED SYSTEMS AND METHODS

(71) Applicant: ExxonMobil Technology and Engineering Company, Spring, TX (US)

(72) Inventors: Serhiy Arabskyy, Alberta (CA); Andrew Barabash, Alberta (CA); Brad Dietz, Alberta (CA); Sean Judge, Alberta (CA)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 18/970,527

(22) Filed: Dec. 5, 2024

(65) Prior Publication Data

US 2025/0092760 A1 Mar. 20, 2025

Related U.S. Application Data

(63) Continuation-in-part of application No. 18/870,364, filed as application No. PCT/CA2023/050718 on May 25, 2023.

(Continued)

(51) Int. Cl.
*E21B 34/14* (2006.01)
*E21B 47/00* (2012.01)

(52) U.S. Cl.
CPC ..... *E21B 34/142* (2020.05); *E21B 47/00* (2013.01); *E21B 2200/06* (2020.05)

(58) Field of Classification Search
CPC ..... E21B 34/142; E21B 47/09; E21B 23/001; E21B 23/04; E21B 23/0413; E21B 23/08; E21B 23/10
See application file for complete search history.

(56) References Cited

U.S. PATENT DOCUMENTS 5,479,986 A 1/1996 Gano et al.
9,683,419 B2 6/2017 Coon
(Continued)

FOREIGN PATENT DOCUMENTS

CA 2948027 A1 5/2017
CA 3037949 A1 9/2020
CA 3107894 A1 8/2022

OTHER PUBLICATIONS

International Search Report and Written Opinion, as issued in connection with International Patent Application No. PCT/CA2023/050718, dated Aug. 8, 2023, 9 pgs.

*Primary Examiner* — Brad Harcourt
(74) *Attorney, Agent, or Firm* — Troutman Pepper Locke LLP

(57) ABSTRACT

An actuation device for actuating a target sleeve valve assembly of a plurality of sleeve valve assemblies in a wellbore tubing string is provided. The device comprises a housing and a catch structure. The catch structure is actuatable between an inactive state and an activated state. In the inactive state, the device may travel through non-target sleeve valve assemblies. In the activated state, the device may be seated in the target sleeve valve assembly. The apparatus has a first sensor operable for detecting a first detectable feature associated with each non-target sleeve valve assembly, and a second sensor operable for detecting a second detectable feature associated with each non-target sleeve valve assembly. The device further includes a controller that increases a sleeve valve assembly count value responsive to detection of the first and second detectable features within a predetermined time window.

25 Claims, 15 Drawing Sheets

Related U.S. Application Data

(60) Provisional application No. 63/346,961, filed on May 30, 2022.

(56) References Cited

U.S. PATENT DOCUMENTS

| | | | |
|---|---|---|---|
| 10,301,927 | B2 | 5/2019 | Sallwasser |
| 10,487,625 | B2 | 11/2019 | Jacob |
| 2011/0240301 | A1 | 10/2011 | Robison et al. |
| 2013/0206402 | A1 | 8/2013 | Coon |
| 2016/0084075 | A1 | 3/2016 | Ingraham et al. |
| 2017/0096876 | A1 | 4/2017 | Flores Perez et al. |
| 2021/0156211 | A1 | 5/2021 | Arabskyy et al. |

ACTUATION DEVICE FOR ACTUATING A TARGET SLEEVE VALVE ASSEMBLY, AND RELATED SYSTEMS AND METHODS

TECHNICAL FIELD

The present disclosure relates to downhole tool operations. More particularly, the present disclosure relates to devices and related systems and methods for selectively actuating downhole tools in a wellbore.

BACKGROUND

In staged wellbore completion operations, a wellbore is drilled to intersect a subterranean formation, and the formation is divided into multiple zones that are treated in isolation. Flow control valves such as sleeve valve assemblies are used to selectively establish fluid communication between a bore of a tubular wellbore string, such as a casing string or completion string, and the formation. Conventional sleeve valve assemblies comprise a tubular housing with a plurality of flow ports and an inner sleeve configured to slide axially with respect to the tubular housing to open and close the flow ports. Multiple sleeve valve assemblies are typically spaced along the casing string to establish fluid communication with different zones of interest along the wellbore.

Actuation of the sleeve valve assemblies is commonly achieved via tools run downhole (e.g. via tubing or wireline) or ball-drop methods. In a ball-drop system, a ball is released into the casing string at surface. The ball falls downhole and engages a ball seat of an inner sleeve of a corresponding sleeve valve assembly. With the ball obstructing fluid flow through the corresponding sleeve valve assembly, the pressure in the casing bore then increases to shift the inner sleeve axially to open the flow ports. To provide the capability to selectively open sleeve valve assemblies at particular zones of interest along the wellbore, the dimensions of the ball seats can be varied. For example, the sleeve valve assemblies can be arranged such that the ball seat of each sleeve valve assembly has a smaller diameter than the one above it. However, a disadvantage of ball-actuated sleeves is that the cross-sectional flow area of the bores of the sleeve valve assemblies decreases toward the downhole end of the wellbore as the diameters of the ball seats decrease.

More complex actuation devices, such as active darts, may be used instead of balls to avoid the need for seats of varying diameters. The darts may be dropped downhole and may be actuatable between an inactive configuration, in which the dart passes through one or more sleeve valve assemblies as it proceeds downhole, and an activated configuration, in which the dart engages a seat of a particular "target" sleeve valve assembly. The dart can be configured to remain in the inactive configuration until it approaches the target sleeve valve assembly, at which point it actuates to the activated configuration. The dart may determine its position relative to the target sleeve valve assembly by detecting impacts with the seats of non-target sleeve valve assemblies as it proceeds downhole through the casing string, actuating to the activated configuration after the total number of detecting impacts corresponds to the expected number of impacts prior to reaching the target sleeve valve assembly. An example of such an active dart is discussed in International PCT Application No. PCT/CA2019/051054, filed on Aug. 1, 2019, and U.S. application Ser. No. 17/165,494, filed on Feb. 2, 2021, the entirety of each of which is incorporated herein.

While active darts enable a staged completion operation to dispense with the need for sleeve valve assemblies having varying seat sizes, the existing mechanisms and methods for counting sleeve valve assemblies and determining the position of the dart relative to the target sleeve valve assembly can result in errors, such as false positives caused by impacts with structures in the wellbore casing other than sleeve valve assemblies. Such false positives may cause the dart to actuate to the activated position prematurely, resulting in engagement of the incorrect stage of the formation.

Some dart-based activation methods also introduce the dart into the wellbore with a ball obstructing a central bore extending through the dart or may introduce a ball into the wellbore to seat on the dart at a later time, in order to obstruct flow in the wellbore casing through the dart. This enables the formation to be stimulated or fractured through the flow ports of the sleeve valve assembly at which the dart is seated. In certain situations, such as in the event of a screen-out of the selected stage, the ball must be removed from the dart to permit flow through the central bore, and the casing as a whole, to allow a subsequent dart to be flowed downhole. The ball is typically removed from the dart by flowing back the well. However, such operations are time consuming, as the ball must be circulated to surface and removed. If not removed, the ball is liable to reseat in the dart once forward circulation down the wellbore casing is resumed. Alternatively, the ball and dart of the screened-out stage can be drilled out using coiled tubing (CT). However, this operation is also time consuming and costly.

SUMMARY

According to an aspect of the disclosure, there is provided an actuation device for actuating a target sleeve valve assembly of a plurality of sleeve valve assemblies in a wellbore tubing string, the plurality of sleeve assemblies including one or more non-target sleeve valve assemblies uphole of the target sleeve valve assembly, the actuation device comprising: a housing; a catch structure on or coupled to the housing, the catch structure being actuatable between an inactive state and an activated state, and wherein the catch structure allows the actuation device to: (i) travel through the one or more non-target sleeve valve assemblies when the catch structure is in the inactive state; and (ii) seat in the target sleeve valve assembly when the catch structure is in the activated state; a first sensor operable for detecting, for each non-target sleeve valve assembly, a first detectable feature associated with the non-target sleeve valve assembly; a second sensor operable for detecting, for each non-target sleeve valve assembly, a second detectable feature associated with the non-target sleeve valve assembly; and a controller operatively coupled to the first and second sensors, wherein the controller increases a sleeve valve assembly count value responsive to detection of the first and second detectable features within a predetermined time window.

In some embodiments, the device further comprises an actuator coupled to the catch structure, and the controller controls the actuator to actuate the catch structure to the activated state when the sleeve valve assembly count value reaches a pre-determined threshold.

In some embodiments, the controller further comprises a power supply and wherein the controller selectively powers the second sensor responsive to detecting of the first detectable feature.

In some embodiments, detecting the first detectable feature comprises the first sensor generating first sensor output responsive to the first detectable feature, and detecting the second detectable feature comprises the second sensor generating second sensor output responsive to the second detectable feature, and the first and second sensor outputs are received by the controller.

In some embodiments, the controller generates a first timestamp responsive to receipt of the first sensor output, and generates a second timestamp responsive to receipt of the second sensor output, and wherein the controller compares the first and second timestamps to determine if the confirmation signal is within the predetermined time window.

In some embodiments: the first sensor comprises at least one of: a magnetometer, a RFID reader, an optical sensor, an acoustic sensor, and a radiation detector; and the second sensor comprises an impact sensor.

In some embodiments, the first sensor comprises the magnetometer.

In some embodiments: the first sensor comprises an impact sensor; and the second sensor comprises at least one of: a magnetometer, a RFID reader, an optical sensor, an acoustic sensor, and a radiation detector.

In some embodiments, the second sensor comprises the magnetometer.

According to another aspect, there is provided, a method performed by an actuation device, the actuation device comprising: a housing; a catch structure on or coupled to the housing, the catch structure being actuatable between an inactive state and an activated state, and wherein the catch structure allows the actuation device to: (i) travel through one or more non-target sleeve valve assemblies when the catch structure is in the inactive state; and (ii) seat in a target sleeve valve assembly when the catch structure is in the activated state; a first sensor operable for detecting, for each non-target sleeve valve assembly, a first detectable feature associated with the non-target sleeve valve assembly; a second sensor operable for detecting, for each non-target sleeve valve assembly, a second detectable feature associated with the non-target sleeve valve assembly; and a controller operatively coupled to the first and second sensors, the method comprising: detecting, using the first sensor, the first detectable feature; detecting, using the second sensor, the second detectable feature; and increasing a sleeve valve assembly count value if the first detectable feature and the second detectable feature are detected within a predetermined time window.

In some embodiments, the device further comprises an actuator coupled to the catch structure, and the method further comprises controlling the actuator to actuate the catch structure to the activated state when the sleeve valve assembly count value reaches a pre-determined threshold.

In some embodiments, the method further comprises providing power to the second sensor responsive to detecting the first detectable feature.

In some embodiments, detecting the first detectable feature comprises: receiving, by the controller, first sensor output from the first sensor, the first sensor output being responsive to the first detectable feature; and receiving, by the controller, second sensor output from the second sensor, the second sensor output being responsive to the second detectable feature.

In some embodiments, the method further comprises: generating a first timestamp responsive to receipt of the first sensor output; generating a second timestamp responsive to receipt of the second sensor output; and comparing the first and second timestamps to determine if the confirmation signal is within the predetermined time window.

In some embodiments, the first sensor comprises at least one of: a magnetometer, a RFID reader, an optical sensor, an acoustic sensor, and a radiation detector; and the second sensor comprises an impact sensor.

In some embodiments, the first sensor comprises the magnetometer.

In some embodiments, the first sensor comprises an impact sensor; and the second sensor comprises at least one of: a magnetometer, a RFID reader, an optical sensor, an acoustic sensor, and a radiation detector.

In some embodiments, the second sensor comprises the magnetometer.

According to another aspect, there is provided a controller for an actuation device comprising: one or more processors, memory having stored thereon processor executable instructions that, when executed by the one or more processors, cause the processor to implement the method as described above or below herein.

Other aspects and features of the present disclosure will become apparent, to those ordinarily skilled in the art, upon review of the following description of the specific embodiments of the disclosure.

DETAILED DESCRIPTION

Generally, the present disclosure provides an actuation device (e.g., "dart") that may be dropped into a wellbore tubing string for actuating a target sleeve valve assembly of a plurality of sleeve valve assemblies in the wellbore tubing string. The plurality of sleeve assemblies may include a target sleeve valve assembly to be opened by the actuation device, and one or more non-target sleeve valve assemblies positioned uphole of the target sleeve valve assembly.

The actuation device may comprise a catch structure, the catch structure actuatable between an inactive state and an activated state, and wherein the catch structure allows the actuation device to (i) travel through the one or more of non-target sleeve valve assemblies when the catch structure is in the inactive state; and (ii) seat in the target sleeve valve assembly when the catch structure is in the activated state. The device may include a first sensor operable to detect, for each non-target sleeve valve assembly, a first detectable feature associated with the sleeve valve assembly, and a second sensor that detects second detectable feature associated with the sleeve valve assembly. The device may further include a controller in communication with the first and second sensors, which receives output from the first and second sensors. The controller increases a sleeve assembly count value responsive to the first and second detectable features being detected within a predetermined time window.

As used herein and in the appended claims, the singular forms of "a", "an" and "the" include plural referents unless the context clearly dictates otherwise.

In this disclosure, the "uphole" direction refers to the direction toward the surface in a wellbore. The "downhole" direction refers to the direction toward the bottom of the wellbore (i.e., opposite to the uphole direction). The terms "upward" and "downward" may be used to refer to the "uphole" and "downhole" directions, respectively, unless the context dictates otherwise. These terms are not limited to vertical movement. For example, uphole or downhole movement may include horizontal movement, for example, in deviated wells.

As using herein, the term "sleeve valve assembly" refers to a sleeve-based flow control valve in a tubing string in a wellbore. Each sleeve valve assembly may be actuatable between a closed state and an open state to selectively establish fluid communication with a particular zone of a subterranean formation to allow that zone to be stimulated or fractured with a treatment fluid pumped through the tubing string. The terms "tubing" and "casing" may be used interchangeably herein to refer to any series of tubes or pipes run downhole in a wellbore.

Figure 1:
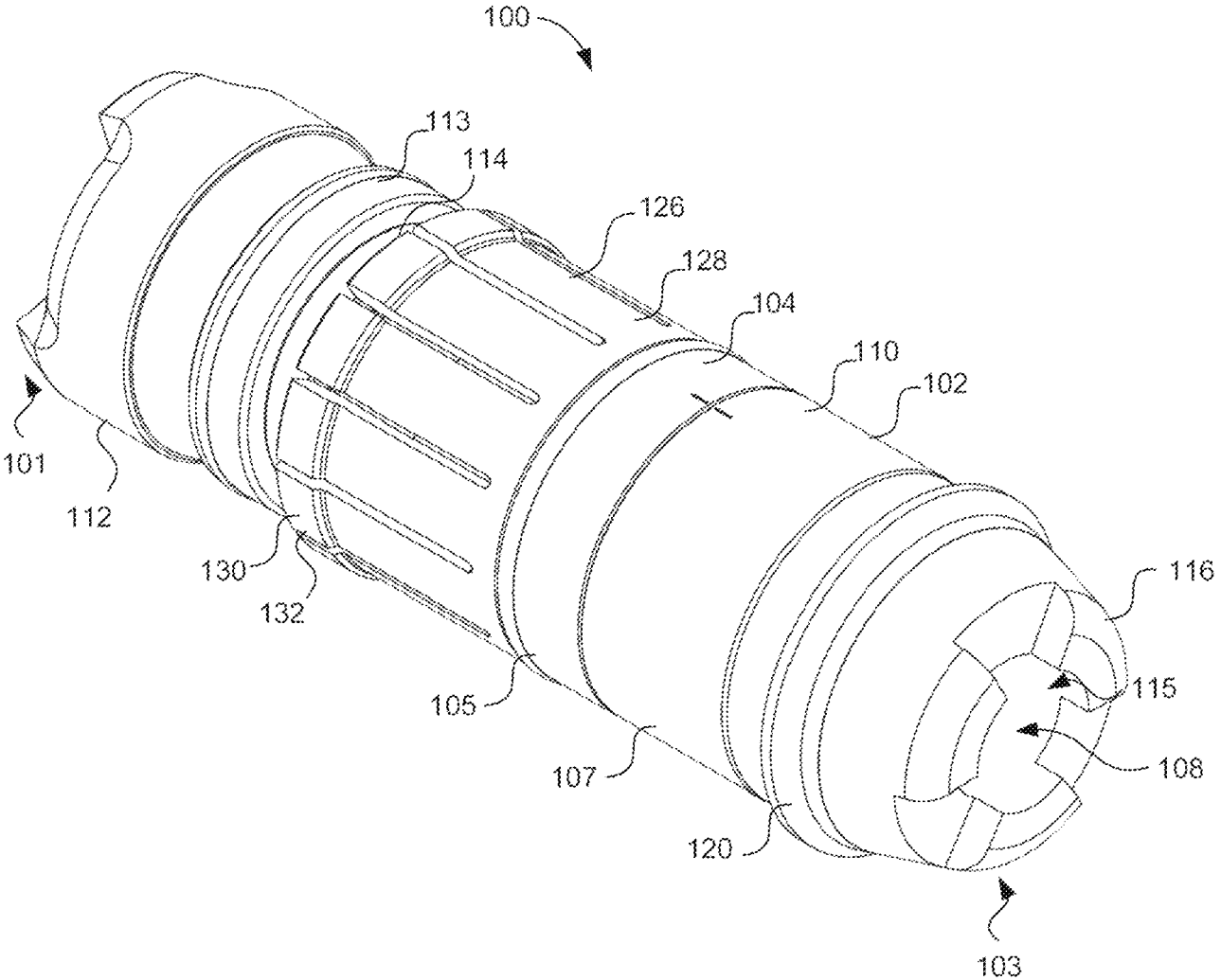
FIG. 1 is a perspective view of an example actuation device, according to some embodiments, shown in an inactive configuration.
Figure 2:
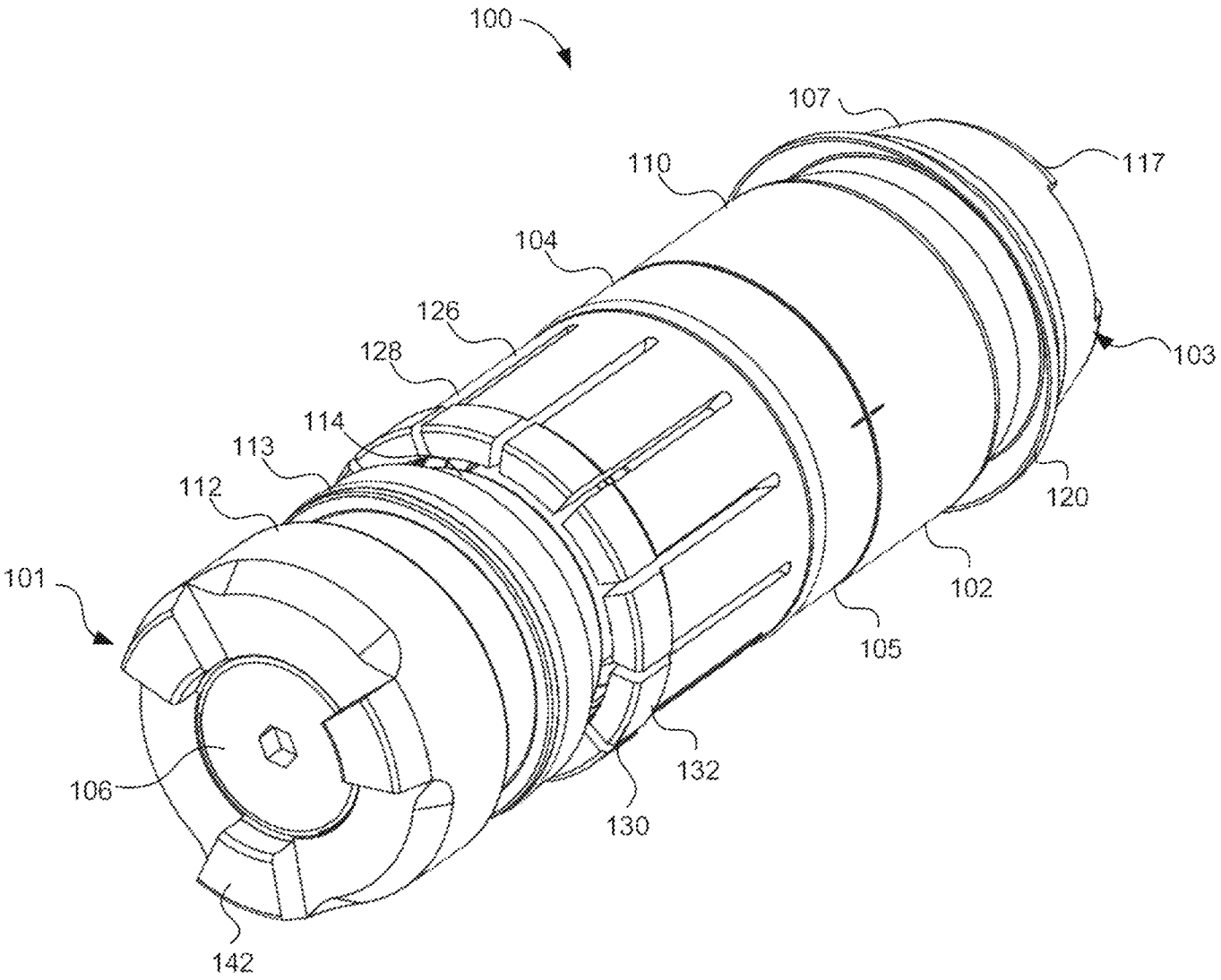
FIG. 2 is a rear perspective view of the actuation device of FIG. 1, shown in an inactive configuration.
Figure 3:
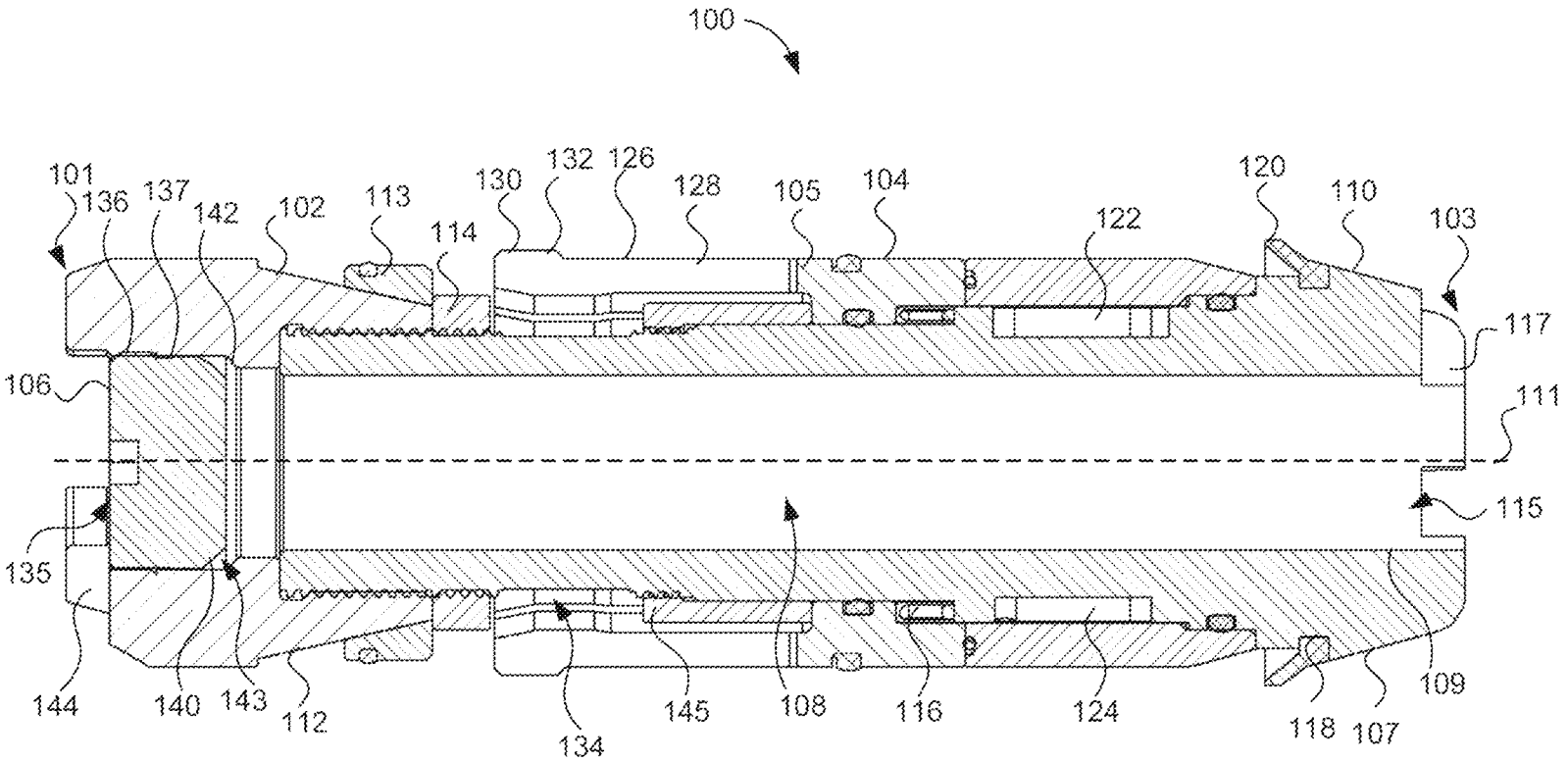
FIG. 3 is a side, cross-sectional view of the actuation device of FIG. 1, shown in an inactive configuration.
Figure 4:
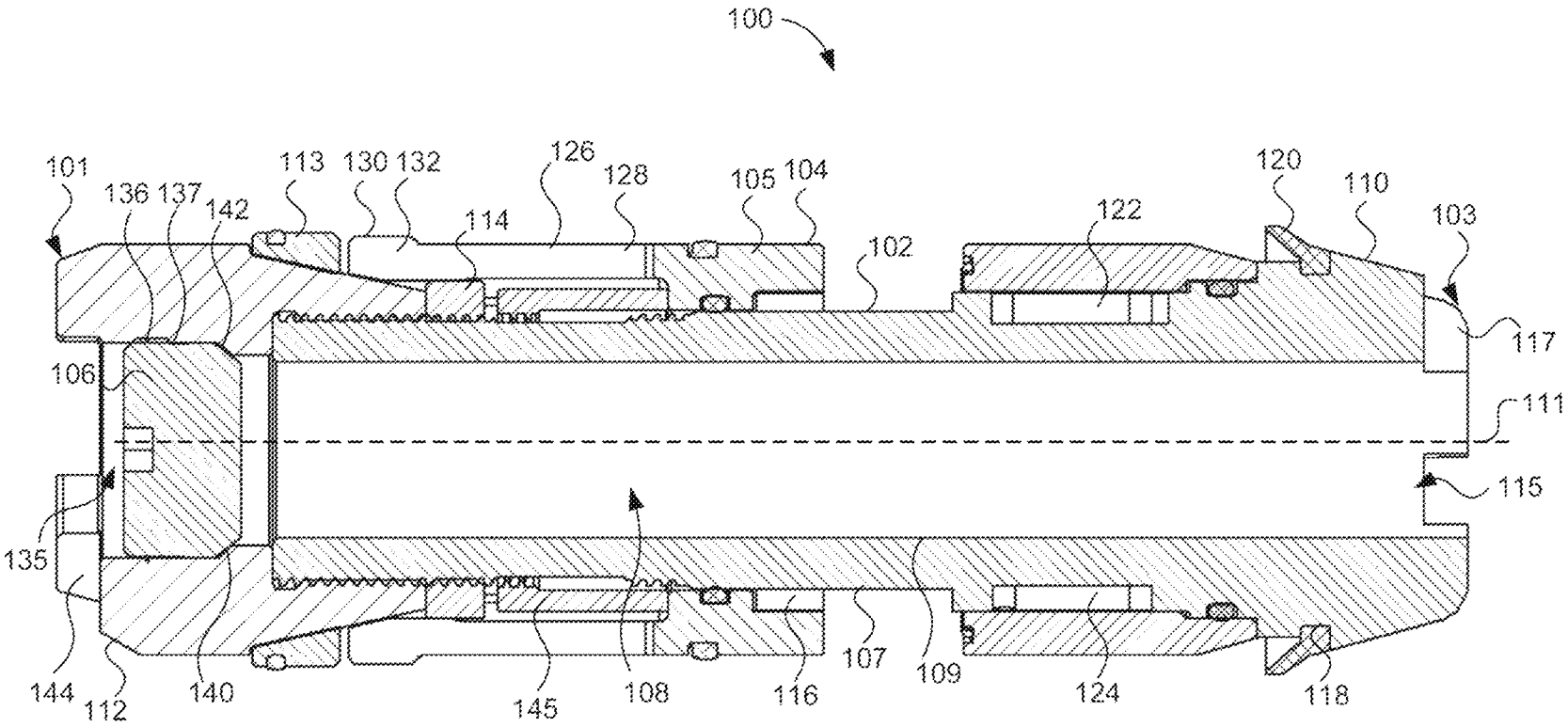
FIG. 4 is a side, cross-sectional view of the actuation device of FIG. 1, shown in an activated configuration.
Figure 5:
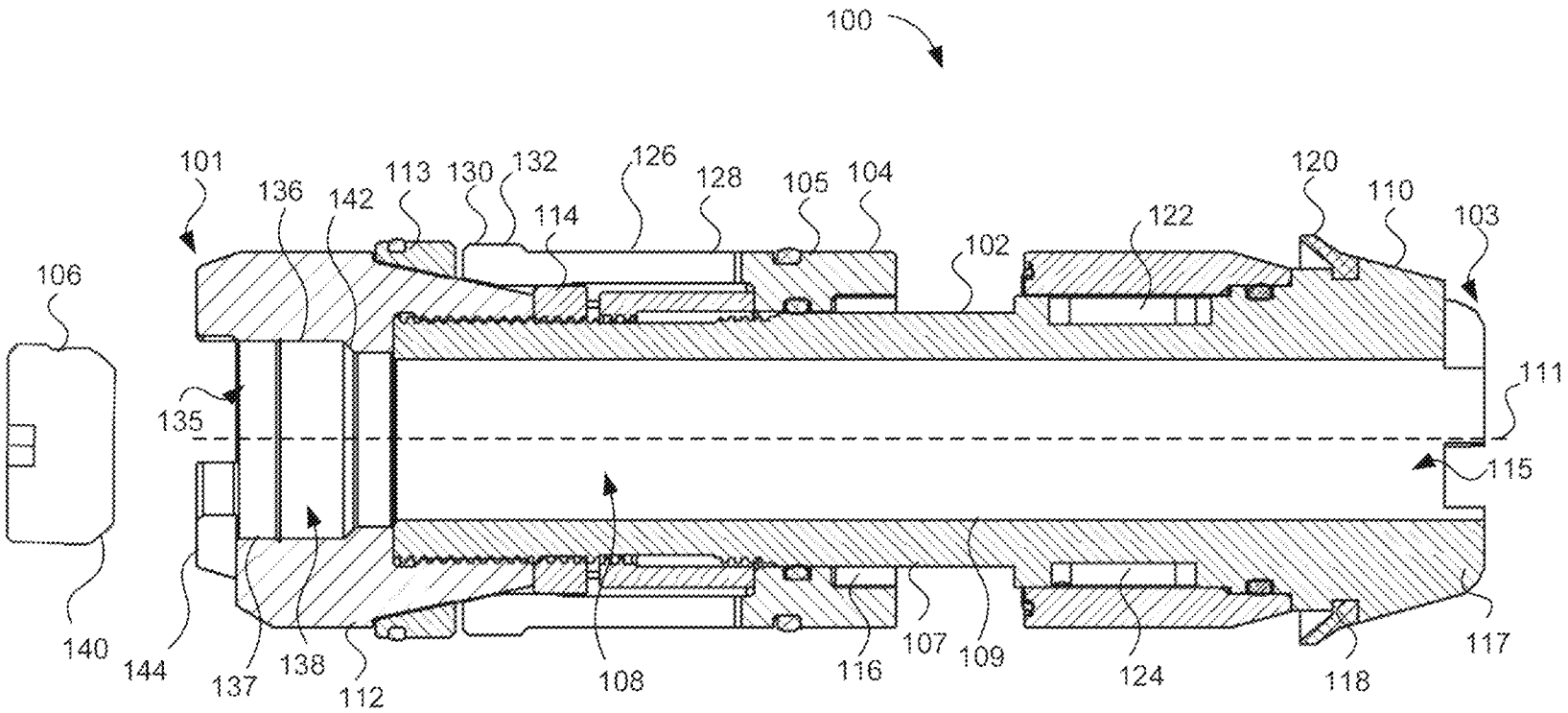
FIG. 5, is a side, cross-sectional view of the actuation device of FIG. 1, shown in the activated configuration with a plug removed.

An example actuation device 100 will be discussed with reference to FIGS. 1 to 5. The actuation device 100 may also be referred to as a "dart" herein. The actuation device 100 has an inactive configuration and an activated configuration. FIGS. 1 to 3 show the actuation device 100 in the inactive configuration and FIGS. 4 and 5 show the actuation device 100 in the activated configuration. In the inactive configuration, the device 100 is configured to pass through one or more sleeve valve assemblies in a tubing string (the "non-target" sleeve valve assemblies). In the activated configuration, the device 100 seats within a particular sleeve valve assembly (the "target" sleeve valve assembly) to actuate that sleeve valve assembly from a closed to an open state.

The device 100 in this embodiment comprises a housing 102, a catch structure 104, and a removable plug 106 (visible in FIGS. 2-5). In this example, the catch structure 104 is part of the housing 102 and forms a part of the external surface of the housing 102. In other embodiments, the catch structure 104 may be separate from the housing.

The housing 102 has an uphole end 101, a downhole end 103, and a longitudinal axis 111 (visible in FIGS. 3-5). As used herein, "longitudinally" and "axially" are used interchangeably to refer to the direction of the longitudinal axis. The housing 102 may have an elongate, tubular shape. In this embodiment, the housing 102 comprises a main housing 110, a cap 112, a slidable sealing ring 113, and an inner support ring 114 therebetween. The cap 112 and the inner support ring 114 may be coupled to the main housing 110 by threaded connections or any other suitable coupling means. In other embodiments, main housing 110 may be integral with one or both of the cap 112 and the inner support ring 114. The sealing ring 113 may be disposed around the cap 112, adjacent to the inner support ring 114.

Referring to FIGS. 3 to 5, the housing 102 has an outer surface 107 and an inner surface 109, the inner surface 109 defining a bore 108 extending axially through the housing 102 from the uphole end 101 to the downhole end 103. The bore 108 allows fluid to flow through the housing 102 when the plug 106 is removed, as described in more detail below.

The cap 112 is at the uphole end 101 of the housing 102 and defines an uphole opening 135 to the bore 108. The cap 112 may comprise one or more protruding members 144 that extend longitudinally past the uphole opening 135 in the uphole direction. The protruding members 144 in this embodiment are wedge-shaped projections. In other embodiments, the protruding members 144 are any other suitable shape.

The main housing 110 defines a downhole opening 115 to the bore 108 and comprises one or more protruding members 117 that extend longitudinally past the downhole opening 115 in the downhole direction. The protruding members 117 may be similar in shape to the protruding members 144. The protruding members 117 may allow fluid to flow through the sides of the device 100 when the plug 106 blocks flow through the bore 108.

The main housing 110 may further comprise a groove 118 proximate the downhole end 103 and extending circumferentially around the main housing 110. The groove 118 may be configured to receive an annular foil 120. The foil 120 may extend radially outward from the groove 118 such that the foil 120 has a greater outer diameter than the main housing 110. The foil 120 may be comprised of soft rubber or any other suitable material. The foil 120 helps create a seal around the device 100 when the device 100 is seated in a target sleeve valve assembly.

The main housing 110 may further comprise at least one chamber between the outer surface 107 and an inner surface 109 thereof. In this embodiment, the main housing 110 comprises a first chamber 122 and a second chamber 124. Each of the first and second chambers 122 and 124 may house one or more elements of a control system (not shown in FIGS. 1 to 5), such as the control system 200 of FIGS. 6A and 6B, described in more detail below. The chambers 122 and 124 in this embodiment are on opposed sides of the main housing 110. In other embodiments, the chambers 122 and 124 are at any other suitable location. In some embodiments, the chambers 122, 124 are each lined with waterproof and insulating material to protect the elements housed therein.

The catch structure 104 is activatable and has an inactive state and an activated state. The inactive state allows the device 100 to travel through the non-target sleeve valve assemblies in the wellbore tubing and the activated state allows the device 100 to seat in a target sleeve valve assembly. The state of the catch structure 104 determines the configuration of the device 100. When the catch structure 104 is in the inactive state, the device 100 is in its inactive configuration and when the catch structure 104 is in the activated state, the device 100 is in its activated configuration. The catch structure 104 may be configured to experience a physical impact as the device 100 passes through each sleeve valve assembly (while the catch structure 104 is in the inactive state). Alternatively, another structure of the device 100 may be configured to experience the physical impact when the catch structure is not activated. The catch structure 104 (or other impact generating structure) may, for example, impact the seat of each non-target sleeve valve assembly as the device 100 passes through each non-target sleeve valve assembly.

In this embodiment, the catch structure 104 comprises an outer sleeve 105. The outer sleeve 105 is positioned around the outer surface 107 of the main housing 110 and is axially movable with respect to the main housing 110. The outer sleeve 105 may be slidable with respect to the main housing 110 between an initial downhole position (shown in FIGS. 1-3) and an uphole position (shown in FIGS. 4 and 5). When the outer sleeve 105 is in the downhole position, it is in the inactive state, and when the outer sleeve 105 is in the uphole position, it is in the activated state.

Figure 7:
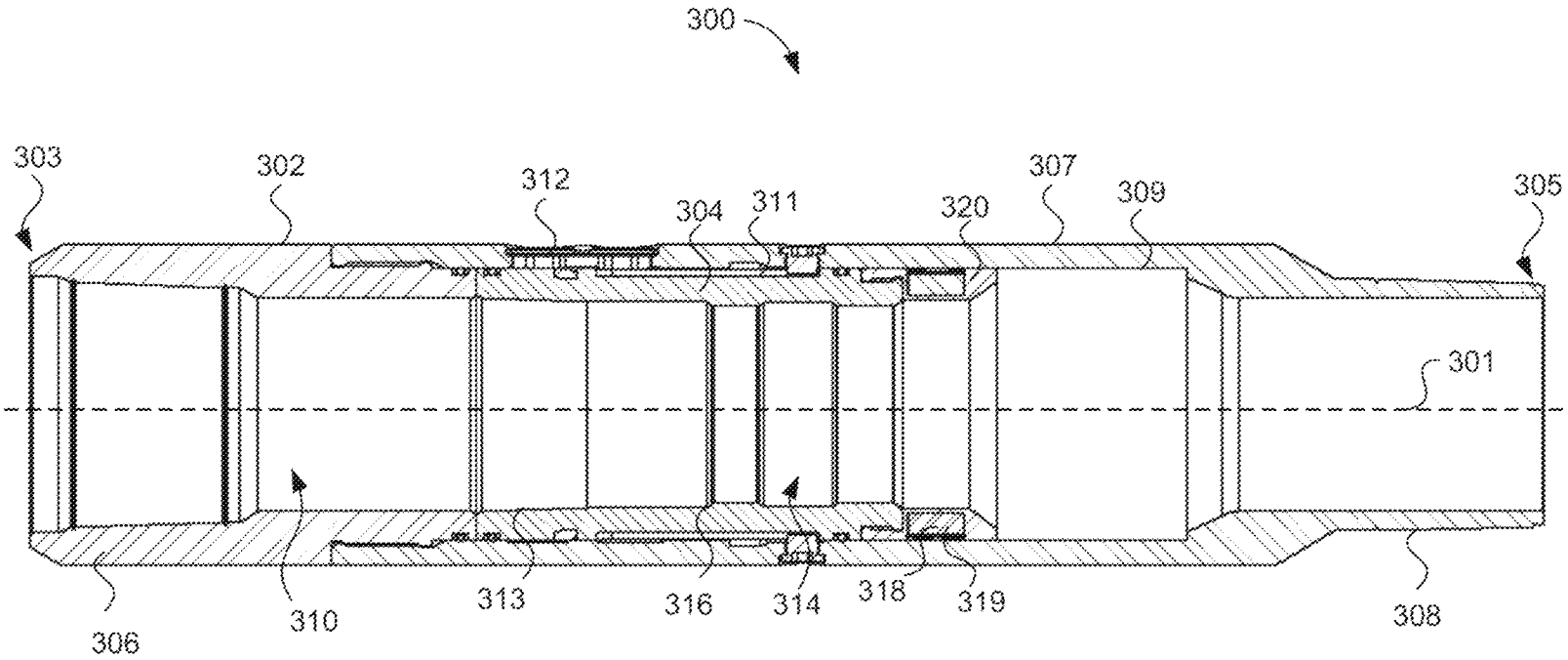
FIG. 7 is a side, cross-sectional view of an example sleeve valve assembly, according to some embodiments, shown in a closed state.

The outer sleeve 105 comprises a seating mechanism 126 for seating in a sleeve valve assembly of a wellbore (such as the sleeve valve assembly 300 of FIG. 7 described below). In this embodiment, the seating mechanism 126 comprises a plurality of fingers 128. Each finger 128 extends longitudinally from the outer sleeve 105 in the uphole direction and terminates in a respective terminal tip 130. Each terminal tip 130 comprises a respected raised portion 132 that project radially outwards from the rest of the fingers 128. The raised portions 132 can thereby engage a corresponding seat in the sleeve valve assembly.

When the outer sleeve 105 is in the downhole position (FIGS. 1-3), the fingers 128 are spaced radially from the main housing 110 such that a gap 134 is provided between the outer surface 107 of the main housing 110 and the terminal tips 130 of the fingers 128 (the gap 134 is visible in FIG. 3). The fingers 128 may bendable such that the terminal tips 130 are able to bend radially inwards towards the main housing 110 and into the gap 134. The fingers 128 may be made of a resilient material to allow them to bend. The bendable fingers 128 thereby allow the device 100 to pass through non-target sleeve valve assemblies and other restrictions in the wellbore tubing when the device 100 is in its inactive configuration.

When the outer sleeve 105 is in the uphole position (FIGS. 4-5), the fingers 128 slide over the inner support ring 114 and onto the cap 112. The fingers 128 are thereby supported by the inner support ring 114 and the cap 112 and cannot bend inwards towards the outer surface 107. The raised portions 132 of the terminal tips 130 thereby engage the seat of the next sleeve valve assembly that the device 100 encounters such that the device 100 seats within that sleeve valve assembly and is able to actuate the sleeve valve assembly as described in more detail below. In this embodiment, the movement of the fingers 128 in the uphole direction also slides the sealing ring 113 upwards on the cap 112 such that the sealing ring 113 can create a metal-to-metal seal with an inner sleeve of the target sleeve valve assembly (see FIGS. 9 and 10, discussed below).

In some embodiments, the outer sleeve 105 is locked in the initial downhole position by a first locking mechanism. In this embodiment, the first locking mechanism comprises a shear collar 145 (see FIG. 3) that shears to release the outer sleeve 105 and allow the outer sleeve 105 to slide axially towards the uphole position (see FIG. 4). In other embodiments, the first locking mechanism may comprise shear screws or another suitable mechanism. In some embodiments, the outer sleeve 105 is locked into the uphole position by a second locking mechanism (not shown). For example, the second locking mechanism may comprise a ridge that engages the terminal tips 130 of the fingers 128 and inhibits axial movement of the outer sleeve 105 in the downhole direction. The second locking mechanism may ensure that the terminal tips 130 remain supported by the inner support ring 114 and prevent the raised portions 132 from bending inwards.

In other embodiments, the outer sleeve 105 may be substituted with any other suitable structure actuatable between an inactive configuration for permitting the device 100 to pass through non-target sleeve valve assemblies and an activated configuration to allow the device 100 to be landed in a seat within a target sleeve valve assembly.

Figure 6A:
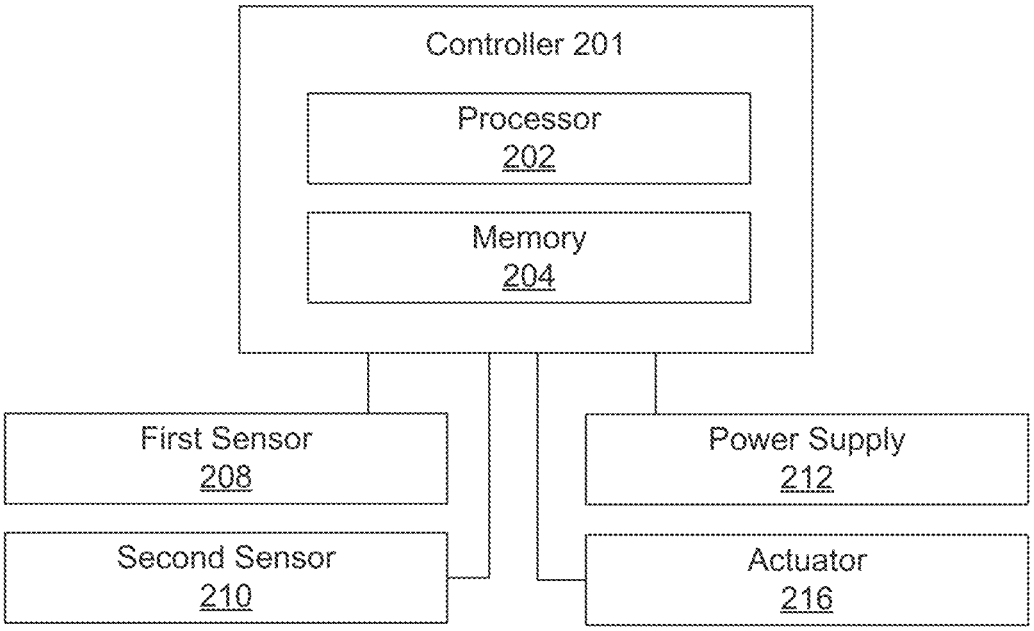
FIG. 6A is a schematic block diagram of an example control system of the actuation device of FIG. 1, according to some embodiments.

The actuation device 100 further includes a control system 200 shown in FIG. 6A, which controls actuation of the actuation device 100 from the inactive state to the active state. FIG. 6A is a functional block diagram of the control system 200 according to some embodiments. The control system 200 includes a controller 201 comprising a processor 202 and memory 204. The control system 200 further includes a first sensor 208 and a second 210 sensor operably coupled to the controller 201. The control system 200 further includes a power supply 212, and an actuator 216, also operatively coupled to the controller 201.

The memory 204 is operatively coupled to the processor 202. The memory 204 stores processor-executable instructions therein that, when executed, cause the processor 202 to implement one or more methods described herein. In this embodiment, the processor-executable instructions include activation code 217 for activating the device 100. The memory 204 also stores settings 218 including other operational parameters of the device 100.

The power supply 212 supplies power to one or more of the components of the control system 200. The power may be selectively supplied to one or more components as needed to implement the methods described herein. While the power supply is shown coupled to the controller 201 in this embodiment, the power supply may also be connected directly to one or more other components, such as the first and/or second sensors 208/210 and/or the actuator 216.

The actuator 216 is configured to actuate the outer sleeve 105 from the downhole (inactive) position to the uphole (activated) position in response to an activation signal from the processor 202. In some embodiments, the activation signal is received by a switch which activates the actuator 216 by allowing current to flow to the actuator 216 from the power supply 212. In other embodiments, the processor 202 may control the actuator 216 in some other manner.

The actuator 216 may comprise any suitable actuation mechanism to shift the outer sleeve 105 from the downhole position to the uphole position. In this embodiment, the actuator 216 comprises a gas charge 116 (visible in FIGS. 3-5) such as a micro gas generator, connected to the outer sleeve 105. The gas charge 116 is configured to generate a rapidly expanding gas that exerts pressure to move the outer sleeve 105 the uphole direction. Alternatively, the actuator 216 can be a hydraulic system driven by an electrical motor to move the outer sleeve 105 hydraulically. In other embodiments, the actuator 216 may comprise any other suitable actuator or combination of actuators to shift the outer sleeve 105 into the uphole (activated) position. The actuator 216 may be disposed in or on the outer sleeve 105 or may be at any other suitable location in the device 100.

The first sensor 208 is operable to detect a first detectable feature associated with each of the one or more sleeve valve assemblies. That is, the first sensor 208 is operable to output, for each of the one or more sleeve valve assemblies, a first sensor output responsive to the first detectable feature. The first sensor output(s) is received by the processor 202.

The second sensor 210 is operable to detect a second detectable feature associated with the one or more sleeve valve assemblies. That is, the second sensor 210 is operable to output, for each of the one or more sleeve valve assemblies, a respective second sensor output responsive to the second detectable feature. The second sensor output(s) is received by the processor 202.

The actuation device 100 may be programed with a target sleeve valve assembly in a plurality of sleeve valve assemblies. The processor 202 may receive output from the first and second sensors 208 and 210 for counting how many sleeve valve assemblies the actuation device 100 has travelled through. When the count indicates that a next sleeve valve assembly is the target sleeve valve assembly, the processor 202 may activate the actuator 216 to move the catch structure 104 (FIGS. 1 to 5) from the inactive state to the active state.

The first sensor 208 or the second sensor 210 may comprise an impact sensor, and the first or second detectable feature may comprise an impact of the actuation device 100 with a physical feature of each sleeve valve assembly counted.

The first sensor 208 or the second sensor 210 may comprise a magnetometer, and the first or second detectable feature may comprise a magnetically detectable element such as one or more magnets in or proximate to each sleeve valve assembly counted.

Some of sensors and corresponding detectable features include, but are not limited to: a RFID reader and RFID tag; an optical sensor (e.g. camera) and light source; an acoustic sensor and acoustic vibration generation means; and a radiation detector and radiation source.

The processor 202 may store and update a "count" value, which corresponds to the number of sleeve valve assemblies which the actuation device 100 has encountered or travelled through. The "count" may be referred to as a sleeve valve assembly count herein. The count value may be increased only when a sleeve valve assembly is detected by both the first and second sensors 208 and 210. This method may effectively constitute "two-factor" sleeve valve assembly detection and may reduce or mitigate false detection of sleeve valve assemblies that could otherwise incorrectly increase the count value.

In some embodiments, the second sensor output from the second sensor 210 functions as a confirmation that the first sensor output from the first sensor 208 is not a false positive. For example, the processor 202 may not increase the count value unless a second sensor output is received within a predetermined time period after receipt of the first sensor output. As another example, the processor 202 may increase the count value each time the first sensor output is received from the first sensor, but the count may be decreased if the second (confirmation) sensor output is not received within the predetermined period.

By way of example, the first sensor 208 may comprise a magnetometer. The tubing string may include, for each sleeve valve assembly, one or more magnets (e.g. ring magnets) within or proximate to the sleeve valve assembly. The second sensor 210 may comprise an impact sensor operable to detect impacts of the actuation device 100 with the sleeve valve assemblies. Alternatively, the first sensor 208 may comprise an impact sensor and the second sensor 210 may comprise a magnetometer. As also noted above, other sensor types (e.g. RFID, optical, etc.) may also be used in addition to or in place of one or both of the first and second sensors 208 and 210.

In some embodiments, power may be supplied to the first sensor 208 while the device 100 travels downhole, and the second sensor 210 may not be powered or activated initially. The processor 202 may selectively "wake up" the second sensor 210 responsive to receiving a first sensor output from the first sensor 208 indicating that a first detectable feature associated with a sleeve valve assembly was detected. For example, responsive to receiving the first sensor output, the processor 202 may cause power to be supplied to the second sensor 210. If a second sensor output is output by the second sensor indicating the second detectable feature associated with the sleeve valve assembly has been detected, the count value may be increased by one. Power to the second sensor 210 may be turned off after expiry of a predetermined period or responsive to receipt of the second sensor output.

By way of example, the first sensor 208 may be a magnetometer and the second sensor 210 may be an impact sensor 210. Each sleeve valve assembly to be counted may have an associated one or more magnets positioned uphole of the seat of the sleeve valve assembly. The magnet(s) may be positioned within the sleeve valve assembly or external to and uphole of the sleeve valve assembly. For a given sleeve valve assembly, the first (magnetic) sensor 208 may detect the corresponding one or more magnets and output a first sensor output to the processor 202. Responsive detection of the magnet(s), the processor may wake up the second (impact) sensor 210. If the second sensor 210 detects an impact with the sleeve valve assembly (e.g. within a predetermined period of time), the count value may be increased accordingly.

Figure 6B:
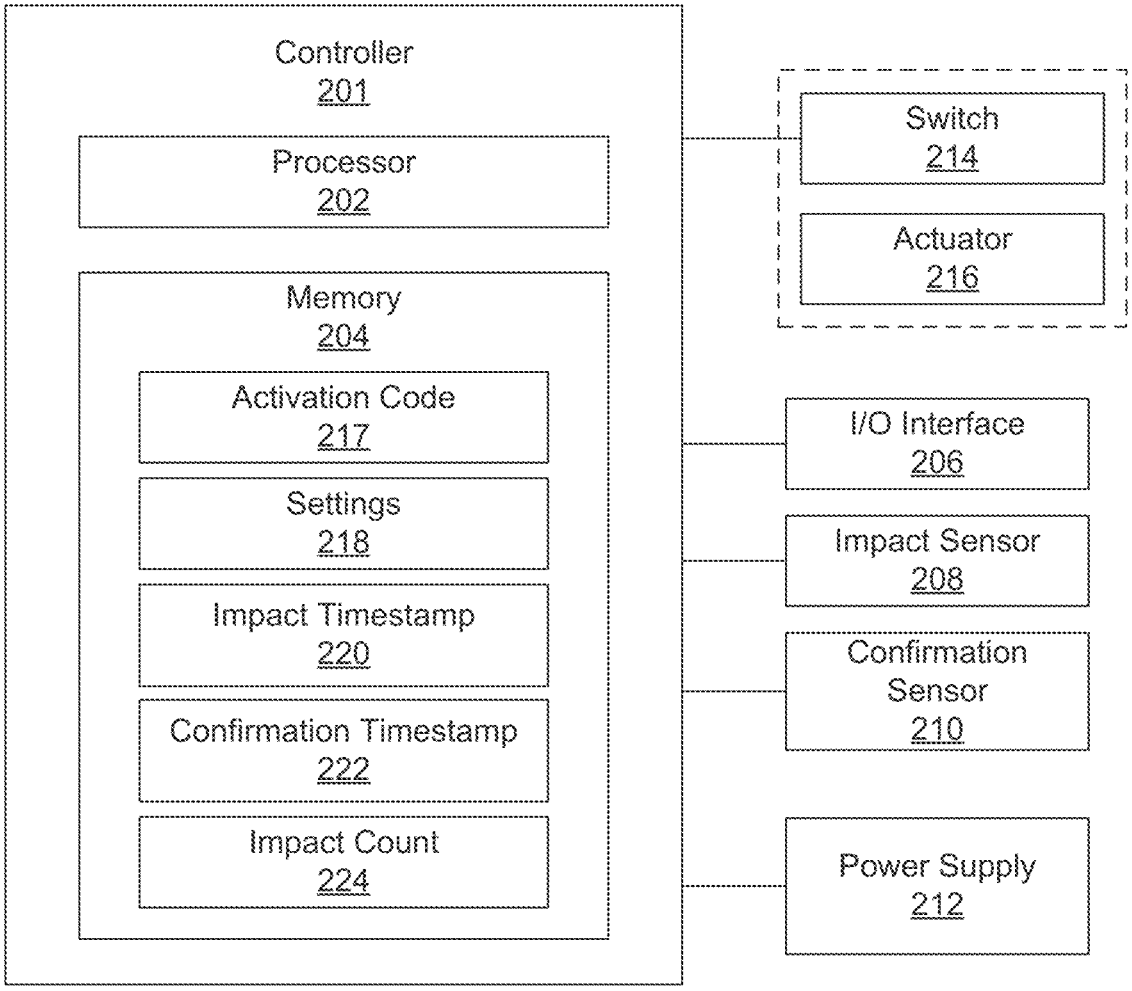
FIG. 6B is a schematic block diagram of an example implementation of the control system of FIG. 6A.

FIG. 6B is a functional block diagram showing additional details of example implementation of the control system 200 of FIG. 6A. The control system 200 in this embodiment includes the controller 201, which includes the processor 202, and memory 204. The control system 200 in this embodiment further includes an I/O interface 206, an impact sensor 208 as the first sensor, a confirmation sensor 210 as the second sensor, the power supply 212, and the actuator 216.

The memory 204 is operatively coupled to the processor 202. The memory 204 stores processor-executable instructions therein that, when executed, cause the processor 202 to implement one or more methods described herein. In this embodiment, the processor-executable instructions include activation code 217 for activating the device 100. The memory 204 also stores settings 218 including other operational parameters of the device 100.

The I/O interface 206 provides a communication link between the controller 201 and external devices. The settings 218 may be configured via the I/O interface 206. The I/O interface 206 may be a wired or wireless interface.

The impact sensor 208 is configured to generate an impact signal (sensor output) to the processor 202 in response to a physical impact experienced by the device 100 as it travels through the wellbore. The impact may be due to contact between the catch structure 104 (i.e., the terminal tips 130 of the fingers 128) and a seat of a sleeve valve assembly as the device 100 passes therethrough or may be due to inadvertent contact between the device 100 and some other structure within the wellbore. In some embodiments, the impact sensor 208 only generates the impact signal if the detected impact is greater than a threshold force. The time at which the impact signal is received may be stored as an impact timestamp 220 in the memory 204.

Non-limiting examples of suitable impact sensors include shock sensors, accelerometers, gyroscopes, strain gauge sensors, proximity sensors, piezoelectric sensors, piezoresistive sensors, capacitive sensors, and acoustic sensors. A number of possible impact sensors are described in International Application No. PCT/CA2019/051054. In some embodiments, the impact sensor 208 comprises two or more of the same or different sensors.

The confirmation sensor 210 is configured to detect a detectable feature associated with at least one sleeve valve assembly (described in more detail below) and generate a confirmation signal (sensor output) to the processor 202 in response thereto. In some embodiments, the detectable feature is a signal emitted by a signal emitter associated with the sleeve valve assembly. In these embodiments, the signal can be referred to as a "handshake" signal and the confirmation sensor 210 can be considered a "handshake sensor". The confirmation signal indicates that the preceding impact signal is due to contact with a sleeve valve assembly and not some other structure. The time at which the confirmation signal is received by the processor 202 may be stored as a confirmation timestamp 222 in the memory 204.

The confirmation sensor 210 is selected based on the type of detectable feature associated with the sleeve valve assemblies installed in the wellbore in which the device 100 will be introduced. For example, if the detectable feature comprises one or more magnets, the confirmation sensor 210 can be a magnetometer configured to detect the magnetic field generated by the magnets. Alternatively, the confirmation sensor 210 can be one or more of: an RFID (radio-frequency identification) reader for detecting one or more RFID tags; a camera and light source for detecting one or more optical bands reflecting light at a predetermined wavelength; an acoustic sensor for detecting specific acoustic waves generated from the physical impact of the device 100 with the sleeve valve assembly; or a radiation detector for detecting a radioactive signature of a radioactive material in or on the sleeve valve assembly. In other embodiments, the confirmation sensor 210 can be any other suitable sensor to detect any other detectable feature of a sleeve valve assembly.

The impact sensor 208 and the confirmation sensor 210 each be housed within one of the chambers 122, 124. The sensors 208, 210 may be housed within the same chamber or different chambers.

The power supply 212 may comprise a battery, capacitor, or any other suitable type of power supply. The power supply 212 may be housed within one of the chambers 122, 124 or elsewhere within the housing 102.

The power supply 212 may be electrically coupled to the processor 202, the sensors 208, 210, and the actuator 216 to supply power thereto. While the power supply is shown coupled to the controller 201 in this embodiment, the power supply may also be connected directly to one or more other components of the system 200. The actuator 216 may be electrically coupled to the power supply via a switch 214. The switch 214 may operate under the control of the processor 202 to control the flow of current from the power supply 212 to the actuator 216.

The processor 202 is operatively coupled to the impact sensor 208 and the confirmation sensor 210 and may be configured to turn the sensors 208, 210 on and off. The processor 202 is also configured to receive impact signals and confirmation signals from the impact sensor 208 and the confirmation sensor 210, respectively. In some embodiments, in response to an impact signal from the impact sensor 208, the processor 202 activates the confirmation sensor 210. In this manner, the control system 200 may conserve power by only activating the confirmation sensor 210 when an impact has been detected. In some embodiments, the confirmation sensor 210 is activated for a predetermined time period (stored in the settings 218) to monitor for the confirmation signal. For example, the time period may be between about 0 and about 1 second.

The processor 202 may then shut off the confirmation sensor 210 until the next impact signal is detected in order to conserve power. In other embodiments, the confirmation sensor 210 may be continuously active.

In some embodiments, the confirmation sensor 210 may initially be inactive when the device 100 is first introduced into a wellbore tubing string to avoid false positives from similar detectable features in the launch mechanism (e.g., magnetic rings). In these embodiments, the processor 202 is configured to activate the confirmation sensor 210 after a suitable time period has elapsed (e.g., 60-90 seconds).

The processor 202 may be further configured to count the number of impact signals that have been confirmed to be due to contact with a sleeve valve assembly based on receipt of a corresponding confirmation signal. Thus, the processor 202 will incrementally increase an "impact count" 224 (or sleeve valve assembly count value) as the device 100 travels through the wellbore. In some embodiments, the impact count 224 is only increased when the confirmation signal is received within a predetermined time window (stored in the settings 218) from the impact signal. In some embodiments, the predetermined time window is within a range of about 0.1 to about 1 second. As one specific example, the predetermined time window may be 0.5 seconds from the impact signal. To determine if the confirmation signal was received within the time window, the processor 202 may compare the confirmation timestamp 222 with the impact timestamp 220, both stored in the memory 204.

In some embodiments, the predetermined time window may be the same amount of time as the time period in which the confirmation sensor 210 is activated as discussed above. In other embodiments, such as when the confirmation sensor 210 is continuously active or active for a longer period of time, the predetermined time window for the confirmation signal may be a shorter length of time.

In alternative embodiments, the processor may initially include all impact signals in the impact count 224 and then subtract from the impact count 224 if the confirmation signal is not received within the time window for a given impact signal.

Thus, the impact count 224 reflects the number of physical impacts experienced by the device 100 that are the result of contact with a sleeve valve assembly, not due to inadvertent contact with other structures, and is therefore a highly accurate indication of the number of sleeve valve assemblies encountered by the device 100. By limiting the time window between the confirmation signal and the impact signal, the risk of false confirmation signals from other detectable features in the wellbore tubing (e.g., magnetic materials) is also mitigated.

When the impact count 224 reaches a pre-determined count threshold (also stored in the settings 218), the processor 202 is configured to send an activation signal to the actuator 216. The pre-determined count threshold may correspond to the number of non-target sleeve valve assemblies in the wellbore before the device 100 reaches the target sleeve valve assembly.

The actuator 216 is configured to actuate the outer sleeve 105 from the downhole (inactive) position to the uphole (activated) position in response to the activation signal from the processor 202. In some embodiments, the activation signal is received by the switch 214, which activates the actuator 216 by allowing current to flow to the actuator 216 from the power supply 212. In other embodiments, the processor 202 may control the actuator 216 in some other manner and the switch 214 may be omitted.

The actuator 216 may comprise any suitable actuation mechanism to shift the outer sleeve 105 from the downhole position to the uphole position, such as gas charge 116 or a hydraulic mechanism, as discussed above. The actuator 216 may be disposed in or on the outer sleeve 105 or may be at any other suitable location in the device 100.

Embodiments are not limited to the specific example hardware configuration shown in FIG. 6B. Any combination of hardware and/or software capable of implementing the methods described herein may be used in other embodiments. For example, one or more of the I/O interface 206, the power supply 212, and the switch 214 may be integrated as internal components of the controller 201 in some embodiments, rather than external to the controller 201. The memory 204 and processor 202 may be integrated within a Central Processor Unit (CPU) chip. Other variations are also possible.

Figure 8:
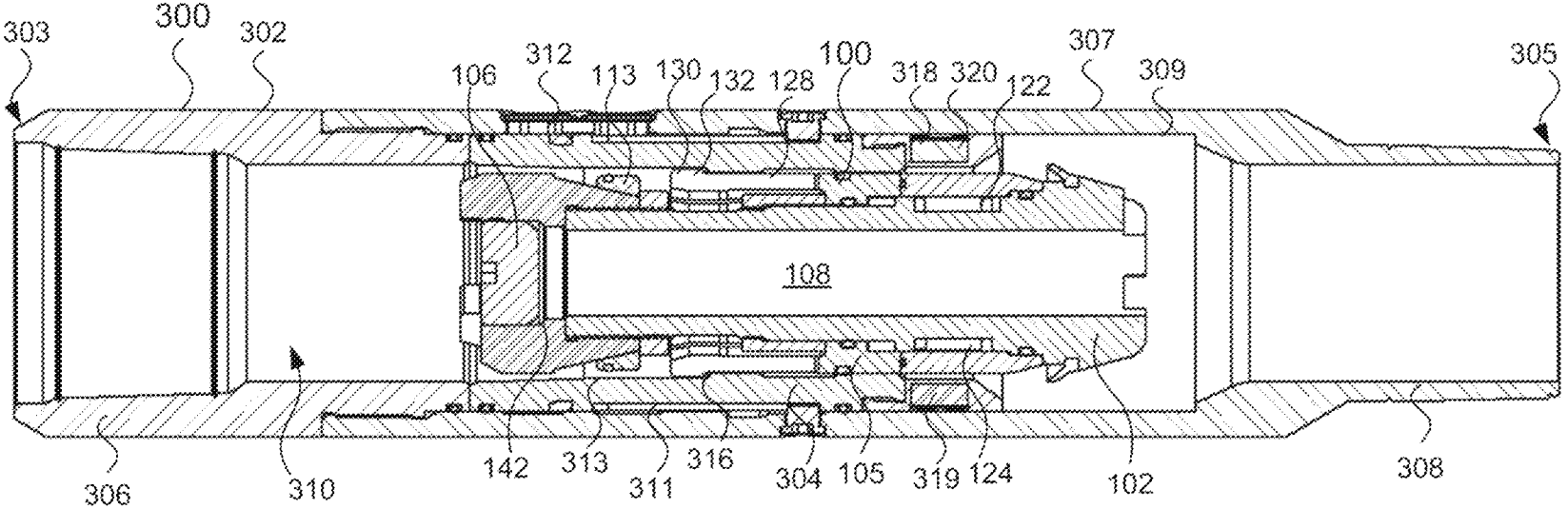
FIG. 8 is a side, cross-sectional view of the actuation device of FIG. 1 received within the sleeve valve assembly of FIG. 7, shown with the actuation device in the inactive configuration and the sleeve valve assembly in the closed state.
Figure 9:
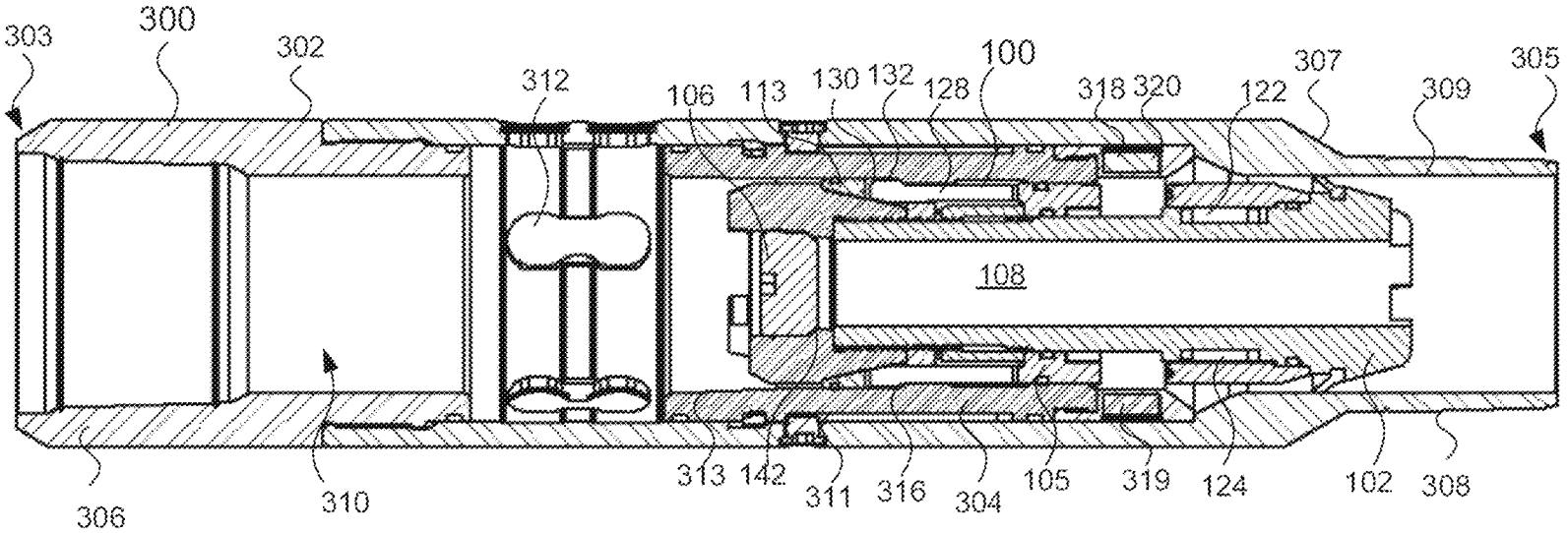
FIG. 9 is a side, cross-sectional view of the actuation device of FIG. 1 received within the sleeve valve assembly of FIG. 7, shown with the actuation device in the activated configuration and the sleeve valve assembly in an open state.
Figure 10:
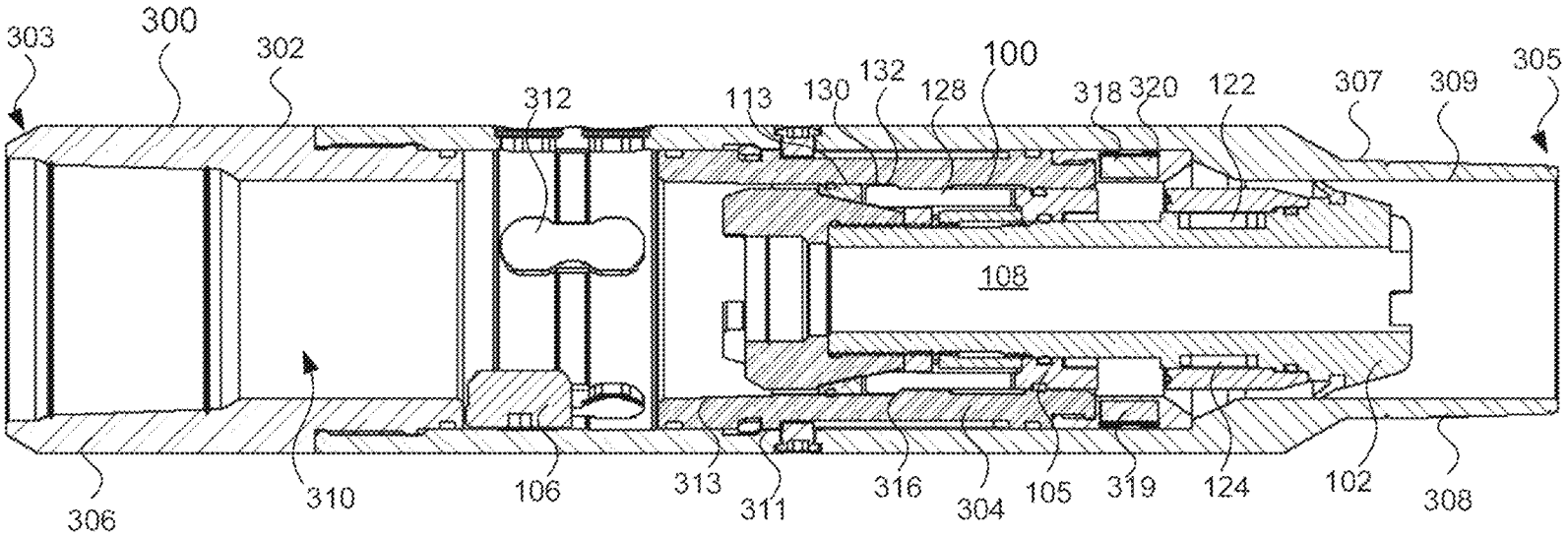
FIG. 10 is a side, cross-sectional view of the actuation device of FIG. 1 received within the sleeve valve assembly of FIG. 7, shown with the actuation device in the activated configuration, the sleeve valve assembly in an open state, and the plug removed from the actuation device.

An example sleeve valve assembly 300 that may be actuated by the actuation device 100 of FIGS. 1-6 will be discussed with reference to FIGS. 7 to 10. FIG. 7 shows the sleeve valve assembly 300 alone and FIGS. 8-10 show the assembly 300 with the actuation device 100 engaged therewith. The sleeve valve assembly 300 has a closed state (FIGS. 7 and 8) and an open state (FIGS. 9 and 10).

The sleeve valve assembly 300 in this embodiment comprises a tubular housing 302 and an actuatable inner sleeve 304 received within the housing 302. The housing 302 has an uphole end 303, a downhole end 305, and a longitudinal axis 301 (shown in FIG. 7). The housing 302 may comprise an upper connection portion 306 and a lower connection portion 308 to allow the housing 302 to be incorporated into a tubing/casing string in a wellbore.

The housing 302 has an external surface 307 and an internal surface 309. The internal surface 309 defines a central bore 310 extending axially (longitudinally) therethrough from the uphole end 303 to the downhole end 305. The central bore 310 allows fluid to flow axially through the housing 302. The housing 302 further comprises one or more flow ports 312 extending radially from the internal surface 309 to the external surface 307 for providing fluid communication between the central bore 310 and the wellbore. In this embodiment, a plurality of flow ports 312 are spaced circumferentially around the housing 302.

The inner sleeve 304 is received within the central bore 310 and is axially movable with respect to the housing 302. The inner sleeve 304 may be slid axially between an uphole (closed) position and a downhole (open) position. When the inner sleeve 304 is in the uphole position (shown in FIGS. 7 and 8), the assembly 300 is in the closed state. In the uphole position, the inner sleeve 304 blocks the flow ports 312 such that the central bore 310 is not in fluid communication with the wellbore and no fluid can flow out of the flow ports 312. When the inner sleeve 304 is in the downhole position (shown in FIGS. 9 and 10), the assembly 300 is in the open state. In the downhole position, the inner sleeve 304 is displaced axially downhole from the flow ports 312 such that flow ports 312 are no longer blocked. Fluid communication is thus permitted between the central bore 310 and the wellbore and fluid may flow out of the assembly 300 via the flow ports 312.

The inner sleeve 304 has an outer surface 311 and an inner surface 313. The inner surface 313 defines a sleeve bore 314 therethrough. The inner surface 313 further comprises a sleeve seat 316. The sleeve seat 316 may be in the form of a ridge or projection extending circumferentially around the inner surface 313. The sleeve seat 316 thereby creates a narrower area of the sleeve bore 314 through which the device 100 is able to pass through in its inactive configuration but not in its activated configuration. When the device 100 is in the inactive configuration, the raised portions 132 of the fingers 128 will impact the sleeve seat 316 and the fingers 128 will flex inward to allow the raised portions 132 to clear the sleeve seat 316. When the device 100 is in the activated configuration, the fingers 128 cannot flex inward and will thus engage the sleeve seat 316 to seat the device within the inner sleeve 304.

The assembly 300 may further comprise at least one detectable feature 318 associated with the housing 302 or the inner sleeve 304. The feature 318 may be detectable by the confirmation sensor 210 of the device 100. The detectable feature 318 may comprise a physical property or characteristic of the housing 302 or inner sleeve 304 itself or may be a structure, material, or device incorporated in or on the housing 302 or the inner sleeve 304. In some embodiments, the detectable feature 318 comprises one or more signal emitters that emits a "handshake" signal detectable by the confirmation sensor 210.

In this embodiment, the detectable feature 318 comprises a plurality of permanent magnets 319 which emit a magnetic field that can be detected by a magnetometer. The magnets 319 are arranged circumferentially around the bore 310 in an annular collar 320 on the internal surface 309 of the housing 302. The collar 320 may be coupled to the inner sleeve 304 such that the collar 320 moves with the inner sleeve 304 as the inner sleeve 304 shifts from the uphole to the downhole position. The collar 320 may be made of a non-magnetic material, such as non-magnetic stainless steel, to reduce or prevent distortion of the magnetic field emitted by the magnets 319.

In other embodiments, the magnets 319 may be positioned on the internal surface 309 of the housing 302 or otherwise associated with the housing 302 or the sleeve 304 in any other suitable way.

The magnets 319 in this embodiment are positioned downhole of the sleeve seat 316. As shown in FIGS. 8-10, when the device 100 is received into the sleeve 304 such that the fingers 128 contact the sleeve seat 316, the chambers 122, 124 (one of which contains the confirmation sensor 210) are in proximity to the magnets 319 to detect the magnetic field. In other embodiments, the magnets 319 may be at any other suitable position such that the magnetic field can be detected by the confirmation sensor 210. In this example embodiment, the magnet 319 is positioned to be sensed shortly after the actuation device 100 impacts the sleeve seat 316. In other embodiments where the magnet 319 is to be detected prior to the impact, the magnet 319 may be positioned to be sensed shortly before the impact with the sleeve seat 316 occurs (the magnet may be above or below the seat 316 in such embodiments, depending on the location of the magnetometer and catch structure 104 of the actuation device 100.

In other embodiments, the detectable feature 318 may comprise: one or more RFID tags; one or more optical bands reflecting light at a predetermined wavelength in the visible or non-visible spectrum (e.g. in the ultraviolet or infrared spectrum); a structure or material configured to generate specific acoustic waves (e.g. acoustic waves with a specific amplitude or frequency) when impacted by the device 100; a radioactive material configured to emit a predetermined radioactive signature; a light source emitting light at a predetermined wavelength; and/or any other feature that could be detected by a corresponding sensor.

Figure 11:
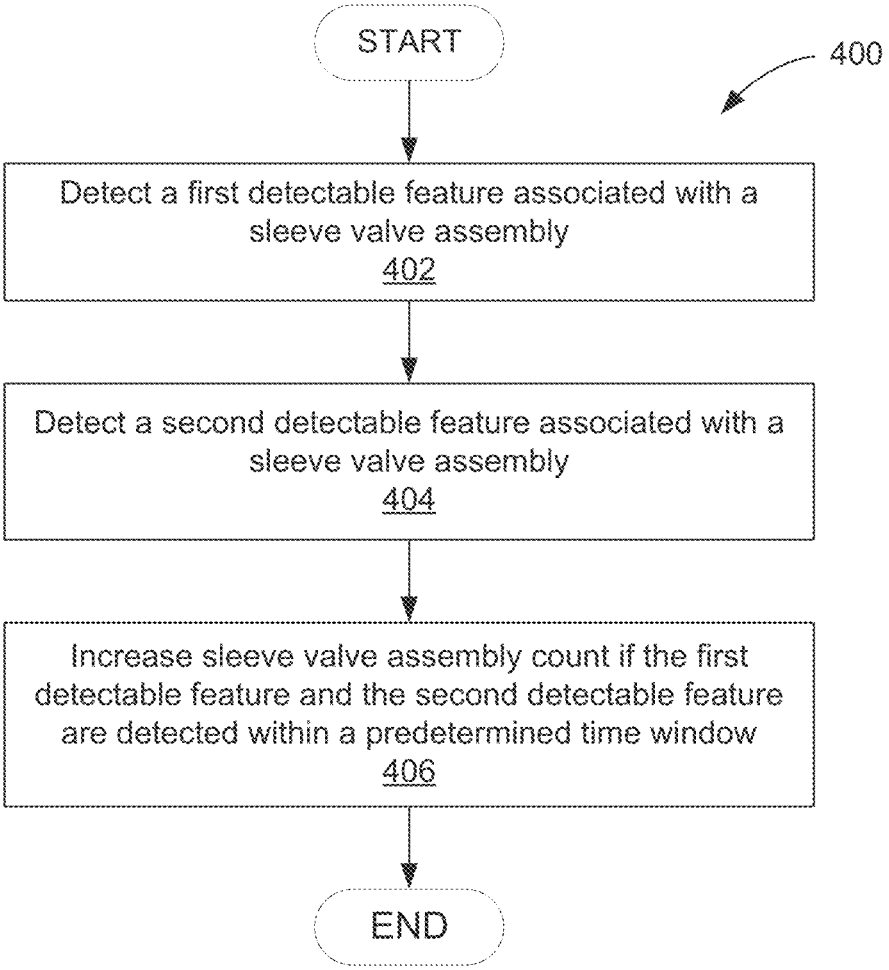
FIG. 11 is a flowchart of an example method using the actuation device of FIGS. 1 to 5, according to some embodiments.

FIG. 11 is a block diagram of an example method 400 that may be performed by the actuation device 100 according to some embodiments. For example, with reference to FIGS. 6A and 6B, the memory 204 may store instructions that, when executed by the processor 202, may cause the processor to implement the method 400.

At block 402, a first detectable feature associated with a sleeve valve assembly is detected using the first sensor 208. The first sensor 208 may generate, as output received by the processor 202, a first signal indicative of the first detectable feature, for example. As explained above, the first sensor 208 may be an impact sensor, and the first detectable feature may be an impact of the actuation device 100 and a structure of the sleeve valve assembly. In other embodiments, the first sensor 208 may instead be a magnetometer, and the first detectable feature may be one or more magnets within or proximate to the sleeve valve assembly.

Optionally, the method may further comprise, upon detecting the first detectable feature using the first sensor 208, providing power to the second sensor 210 (i.e. 'waking up' or activating the second sensor) as described herein.

At block 404, a second detectable feature associated with the sleeve valve assembly is detected using the second sensor 210. The second sensor 210 may generate, as output received by the processor 202, a second signal indicative of the second detectable feature, for example. The second sensor 210 may be a different type of sensor than the first sensor 208. For example, where the first sensor 208 is an impact sensor, the second sensor 210 may be a magnetometer that detects one or more magnets as the second detectable feature (or vice versa).

At block 406, a sleeve valve assembly count value is increased (e.g. by the processor 202) if the first detectable feature and the second detectable feature are detected within a predetermined time window. Detecting the first detectable feature and the second detectable feature may comprise the first and second sensors 208 and 210 generating the first and second signals, respectively, and the processor receiving the first and second signals from the sensors 208 and 210 within the time window.

The method may further comprise, upon the sleeve assembly count value reaching a predetermined number (corresponding to the next sleeve assembly being the target sleeve assembly), actuating the catch structure 104 to the activated position.

Figure 12:
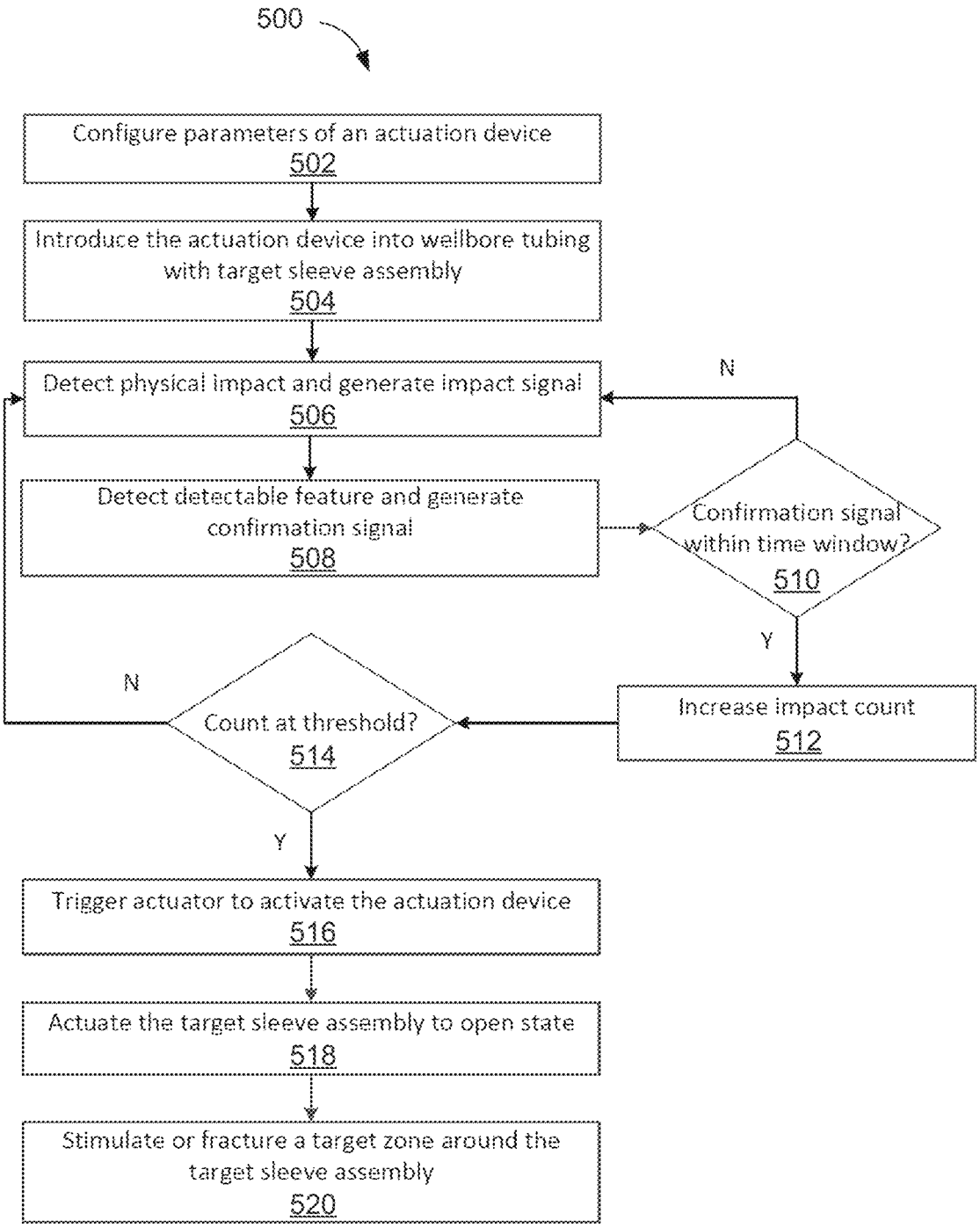
FIG. 12 is a flowchart of an example method for treating a formation, according to some embodiments.

FIG. 12 is a flowchart of an example method 500 for treating a formation, according to some embodiments. The method 500 may be implemented using the device 100 and the sleeve valve assembly 300.

Prior to the method 500, a series of sleeve valve assemblies 300 may be installed at desired intervals along a tubing string in a wellbore for stimulating or fracturing particular zones in a subterranean formation. One of the sleeve valve assemblies 300 may be identified as the "target" sleeve valve assembly and all sleeve valve assemblies uphole of the target assembly are "non-target" sleeve valve assemblies.

At block 502, the device 100 is configured (via the settings 218) with selected operational parameters. The parameters may include a pre-determined count value threshold based on the number of non-target assemblies that the device 100 must pass through before reaching the target assembly. The device may also be configured with a predetermined time window based on the anticipated time to detect the detectable feature 318 by the confirmation sensor 210 after the physical impact between the catch structure 104 and the sleeve seat 316 is detected by the impact sensor 208.

At block 504, the device 100 is introduced into the wellbore tubing. The device 100 is introduced in its inactive configuration and flowed with a treatment fluid in the downhole direction. When the device 100 reaches a non-target sleeve valve assembly 300, the fingers 128 of the outer sleeve 105 will flex to allow the device 100 to pass through the sleeve seat 316 of that sleeve valve assembly 300. As the device 100 passes through, the raised portions 132 of the terminal tips 130 of the fingers 128 will contact the sleeve seat 316. FIG. 8 shows the device 100 in its inactive configuration as it passes through a non-target sleeve valve assembly 300 in its closed state.

The steps at blocks 506 to 516 of the method 500 are performed by the control system 200 of the device 100. At block 506, the physical impact is detected, via the impact sensor 208, and an impact signal is generated to the processor 202. If the confirmation sensor 210 is not already active, the processor 202 will cause the power supply 212 to power the confirmation sensor 210. At block 508, a detectable feature 318 is detected, via the confirmation sensor 210, and a confirmation signal is generated to the processor 202. At block 510, the processor 202 will determine if the confirmation signal was received within the predetermined time window. If the processor 202 receives the confirmation signal within the predetermined time window ("Y" branch at block 510), the method 500 will proceed to block 512 and the processor 202 will increase the impact count 224. If the confirmation signal is not received within the time window ("N" branch at block 510), the impact count 224 does not increase and the method 500 goes back to block 506 to monitor for the next physical impact.

If the impact count 224 increases at block 512 then, at block 514, the processor 202 will determine if the impact count 224 is at the pre-determined threshold. If the impact count 224 is not at the threshold ("N" branch at block 514), the method 500 will return to block 506 and the steps at blocks 506 to 514 will be repeated until the threshold is reached. This process will continue as the device 100 travels downhole through the tubing and passes through the non-target sleeve valve assemblies.

If the impact count 224 is at the threshold ("Y" branch at block 514), the method 500 will proceed to block 516 just prior to the device 100 reaching the target sleeve valve assembly 300. At block 516, the actuator 216 is triggered to activate the device 100. The processor 202 sends an activation signal to the actuator 216 such that the actuator 216 causes the outer sleeve 105 to slide axially into its uphole (activated) position. The device 100 will thereby be in its activated configuration. When the device 100 reaches the target sleeve valve assembly 300, the raised portions 132 of the fingers 128 of the outer sleeve 105 will engage the sleeve seat 316 such that the device 100 seats in the target sleeve valve assembly 300.

At block 518, the target sleeve valve assembly is actuated, by the actuation device 100, into its open state. The combination of the impact of the device 100 on the sleeve seat 316 and the pressure of the treatment fluid, may push the inner sleeve 304 of the sleeve valve assembly 300 to its downhole position, thereby exposing the flow ports 312 and providing fluid communication between the bore 310 and the annulus of the wellbore (not shown). FIG. 9 shows the device 100 in its activated configuration seated in a target sleeve valve assembly 300 in its open state.

At block 520, the target zone in the formation proximate to the target sleeve valve assembly is stimulated or fractured. At this stage, the treatment fluid is pumped through the tubing string and flows into the formation via the flow ports 312. The plug 106 prevents fluid from flowing through the axial bore 108 of the device 100 and the sealing ring 113 of the device 100 forms a seal between the device 100 and the inner sleeve 304 to prevent fluid from flowing around the sides of the device 100. Thus, the treatment fluid is diverted radially outward through the flow ports 312 into the formation.

If it is desired to stimulate or fracture another zone of the formation, a new target sleeve valve assembly 300 will be identified (uphole of the previous target). The method 500 may then be repeated with a new device 100 configured with a new pre-determined count value threshold.

In alternative embodiments, a well tubing string can be provided with only select sleeve valve assemblies having a detectable feature. For example, a group of multiple sleeve valve assemblies may be installed in a region with multiple target zones and only the most downhole sleeve valve assembly of the group may have a detectable feature while the rest do not. In this manner, the actuation device 100 will count the number of groups of sleeve valve assemblies, rather than each individual sleeve valve assembly. This embodiment may be particularly useful for well tubing strings that contain groups of sleeve valve assemblies in which multiple assemblies have retractable sleeve seats (not shown) and only the most downhole assembly has a solid sleeve seat (such as the sleeve seat 316 of the sleeve valve assembly 300). The retractable sleeve seats may produce less detectable impacts on the actuation device 100, which could lead to an inaccurate count. The device 100 and the method 500 avoid that issue by only counting the sleeve valve assembly with the solid sleeve seat (i.e., the sleeve valve assembly with the detectable feature). Thus, the device 100 is able to maintain an accurate count of the number of sleeve valve assembly groups.

Therefore, embodiments of the devices and methods described above allow for more accurate counting of sleeve valve assemblies in wellbore tubing strings to ensure that the correct target sleeve valve assembly is actuated.

Removable Plug

The plug 106 of the device 100 will be discussed in more detail with reference to FIGS. 3 to 5.

The plug 106 is configured to removably engage the cap 112 of the housing 102 to close the uphole opening 135 and prevent fluid from flowing downhole into the bore 108. The cap 112 in this embodiment comprises a plug seat 136 at the uphole end 101 that receives the plug 106 therein. The plug seat 136 comprises an inner wall 137 that defines a cavity 138 (the cavity 138 is visible in FIG. 5). The cavity 138 has a complementary shape and size to the plug 106 such that the plug 106 snugly engages the inner wall 137. In this embodiment, the cavity 138 is approximately cylindrical in shape. The plug seat 136 may further comprise a ridge 142 that extends circumferentially around the inner wall 137 to receive the plug 106 thereon.

The plug 106 may have a non-spherical shape. In this embodiment, the plug 106 is approximately cylindrical in shape with a circular profile. In other embodiments, the plug 106 can be another non-spherical shape including, for example, a shape with a polygonal profile such as a square, hexagonal, or octagonal profile. In this embodiment, the plug 106 has a tapered portion 140 that is configured to seat onto the ridge 142 of the plug seat 136. In some embodiments, a sealing member (not shown) may also be provided between the plug 106 and the inner wall 137 of the plug seat 136, such as an O-ring or another elastomeric sealing member.

In some embodiments, the plug 106 is secured within the plug seat 136 by a releasable securing mechanism (not shown). The securing mechanism may couple the plug 106 to the cap 112 of the housing 102 in a manner that allows the plug 106 to be released and removed from the housing 102. Non-limiting examples of releasable securing mechanisms include shear threads, shear screws, shear pins, a detent-and-groove mechanism, and the like. For example, the outer surface of the plug 106 and the inner wall 137 of the plug seat 136 may comprise complementary shear threads. As another example, one or more shear pins or screws may extend through respective apertures (not shown) in the plug 106 and the inner wall 137 of the plug seat 136 to releasably couple the plug 106 and cap 112.

In some embodiments, the plug 106 is secured within the plug seat 136 such that a gap 143 is provided between the tapered portion 140 of the plug 106 and the ridge 142 of the plug seat 136 (the gap 143 is visible in FIG. 3).

The securing mechanism may be configured to release the plug 106 at a pre-determined threshold force. For example, the shear threads or shear screws/pins may be configured to shear when a requisite casing pressure is met or exceeded. The release of the securing mechanism may be irreversible such that the plug 106 cannot be re-secured to the housing 102.

In use, the device 100 may be introduced into a wellbore casing with the plug 106 initially secured to the housing 102 such that the plug 106 travels with the housing 102 until the device 100 reaches the target sleeve valve assembly. Then, when the threshold force is achieved, the securing mechanism is released and the downhole flow of fluid may push the plug 106 downhole such that the gap 143 is closed and the plug 106 seats on the ridge 142 (see FIGS. 4 and 9). The plug 106 will then block the flow of fluid downhole through the bore 108, for example, during a fracturing or stimulation operation. As discussed below, to remove the plug, the circulation of fluid may be reversed such that fluid may flow uphole through the bore 108 to push the plug 106 out of the housing 102.

The non-spherical shape of the plug 106, and the close fit between the plug 106 and the plug seat 136 (as well as the irreversible nature of the releasable securing mechanism), essentially eliminates the ability of the plug 106 to fully re-seat in the plug seat 136 once the plug 106 has been removed. Thus, once the plug 106 has been removed, fluid can flow downhole through the bore 108 of the device 100. Even if the plug 106 partially re-seats, such an orientation would still permit sufficient flow through the bore 108 for typical completions operations.

Figure 13:
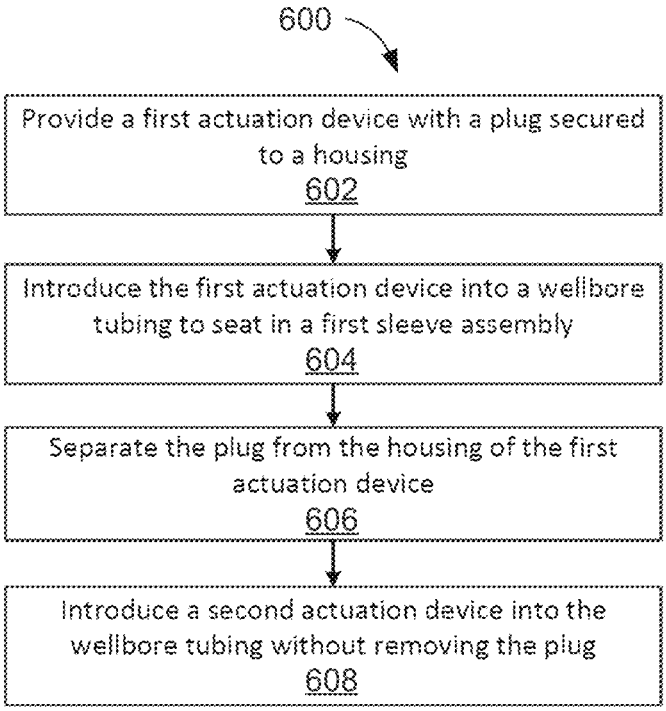
FIG. 13 is a flowchart of another example method for treating a formation, according to some embodiments.

FIG. 13 is a flowchart of another example method 600 for treating a formation, according to some embodiments. The method 600 may be implemented using the device 100 and the sleeve valve assembly 300. In other embodiments, the method 600 may be implemented using any other suitable type of sleeve valve assembly.

Prior to the method 600, a series of sleeve valve assemblies 300 may be installed at desired intervals along a tubing string in a wellbore.

At block 602, a first actuation device 100 is provided with a plug 106 secured to a housing 102 to block fluid flow through an axial bore 108 extending therethrough. The term "provide" in this context refers to acquiring, making, assembling, purchasing, or otherwise obtaining the actuation device. The plug 106 may be secured to the housing 102 by any of the securing mechanisms described above such as shear threads or shear screws/pins.

At block 604, the first actuation device 100 is introduced into the wellbore tubing such that it seats in a first sleeve valve assembly 300. The first actuation device 100 may actuate the first sleeve valve assembly 300 to its open state and then a target zone around the first sleeve valve assembly 300 may be stimulated or fractured with a treatment fluid. In some embodiments, the steps at block 604 are the same or similar to the steps of the method 400 or 500 of FIG. 11 or 12 as described above.

At block 606, the plug 106 is separated from the housing 102 of the first actuation device 100. In some embodiments, separating the plug 106 comprises first releasing the securing mechanism that secures the plug 106 to the housing 102. In some embodiments, the securing mechanism is released by increasing the pressure in the wellbore tubing. For example, downhole pressure may increase to a pre-determined threshold force at which the shear threads or shear screws/pins securing the plug 106 in the plug seat 136 are sheared. The plug 106 may then be released from the plug seat 136. The force of the treatment fluid flowing downhole may shift the plug 106 downwards such that the plug 106 seats on the ridge 142 (see FIGS. 4 and 9). In this position, the plug 106 is unsecured but the metal-to-metal contact between the plug 106 and the ridge 142 will continue to block downhole fluid flow through the bore 108 as the stimulation or fracturing procedure continues.

When it is desired to separate the plug 106 from the housing 102 completely, the circulation of fluid through the wellbore tubing may be reversed such that fluid flows in the uphole direction. The fluid may flow uphole through the axial bore 108 of the device 100 (via the downhole opening 115) and the force of the fluid may push the unsecured plug 106 out of the housing 102. FIG. 10 shows the plug 106 separated from the housing 102 and free within the housing 302 of the sleeve valve assembly 300.

With the plug 106 separated from the housing 102, the flow of fluid can return to the downhole direction and fluid can flow downhole through the axial bore 108 of the device 100 via the uphole opening 135. As discussed above, the plug 106 is shaped and sized to prevent the plug 106 from re-seating in the plug seat 136 once it has been separated.

At block 608, a second actuation device 100 is introduced into the wellbore tubing without removing the plug 106 of the first actuation device 100 from the wellbore tubing. The second actuation device 100 can then seat in a second sleeve valve assembly 300, uphole of the first sleeve valve assembly 300, and can actuate the second sleeve valve assembly 300 into its open state to stimulate or fracture another zone of the formation.

The method 600 may therefore be useful in the event of a screen-out at the first sleeve valve assembly 300 which would otherwise prevent fluid from being pumped downhole to deliver the second actuation device 100 to the second sleeve valve assembly 300. By separating the plug 106 from the first actuation device 100, fluid can flow through the axial bore 108 and continue downhole of the screened-out stage, thereby re-establishing fluid flow to allow the second actuation device to be flowed downhole.

Compared to ball-based methods, the method 600, using the device 100, does not require the plug 106 to be completely removed from the tubing via recirculation, or drilling out, before introducing the second actuation device 100. Instead, the plug 106 can remain in the tubing as it is unable to fully re-seat in the first actuation device 100. In addition, the plug 106 design mitigates the risk of the plug 106 inadvertently blocking the downhole opening 115 of the second actuation device 100 above it. The plug 106 thus does not have the same flowback issues that can happen with balls.

Following the steps of method 600, the housings 102 of the devices 100 seated in respective sleeve valve assemblies may be degraded or dissolved to allow a hydrocarbon extraction process to commence. For example, the housings 102 may be dissolved by pumping a dissolving fluid through the wellbore tubing. By removing the plug 106 prior to introduction of the dissolving fluid, the fluid may flow through the axial bore 108 to accelerate dissolution of the housing 102. In some embodiments, the plugs 106 may also be dissolved and the non-spherical shapes of the plugs 106 may facilitate such dissolution by providing a greater surface area and/or volume of material compared to conventional balls.

Figure 14:
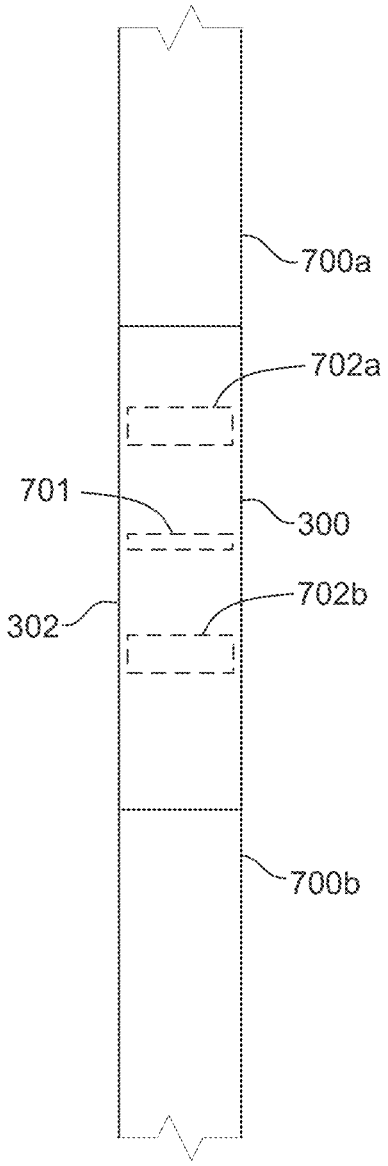
FIG. 14 is a side view of an example sleeve valve assembly connected between an upper casing section and a lower casing section.

Detectable features such as magnet(s), the seat (for impact sensor embodiments), RFID tags, etc. may be positioned such that the first sensor of the actuation device 100 detects the corresponding first detectable feature before the second sensor detects the corresponding second detectable feature. FIG. 14 is a side view of an example sleeve valve assembly 300 connected between an upper casing section 700*a* (partially shown) and a lower casing section 700*b*. FIG. 14 illustrates non-limiting example positions (702*a*, 702*b*) for a detectable feature relative to an approximate position 701 of a sleeve seat of the inner sleeve (not shown in FIG. 14, but shown in FIGS. 7 to 10). The approximate position 701 of the sleeve seat shown may be the position of the seat when the inner sleeve is in the uphole position.

In the case where the actuation device 100 comprises a magnetometer as either the first or second sensor 208 or 210, the sleeve valve assembly 300 may include one or more magnets (such as magnet 319 shown in FIGS. 7 to 10) positioned either uphole of the seat, such as position 702*a*, or downhole of the seat, such as position 702*b*. As another option, the magnet(s) may be positioned in the casing section 700*a* above the sleeve assembly 300 or in the casing section 700*b* below the sleeve assembly 300. In the case of an RFID tag reader, an RFID tag may similarly be positioned above or below the seat position 701. One or more magnets, RFID tags, and/or other detectable features may be positioned in the inner sleeve 304 of the sleeve assembly 300 or in the housing 302. If the first sensor 208 is a magnetometer and the second sensor 210 is an RFID sensor, then one or more magnets and RFID tag(s) may be positioned accordingly in or proximate to the sleeve valve assembly 300. Other variations are also possible in accordance with the principles described herein.

Although some specific embodiments have been shown and described, it will be appreciated by those skilled in the art that various changes and modifications can be made to those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof.

The invention claimed is:

1. An actuation device for actuating a target sleeve valve assembly of a plurality of sleeve valve assemblies in a wellbore tubing string, the plurality of sleeve assemblies including one or more non-target sleeve valve assemblies uphole of the target sleeve valve assembly, the actuation device comprising:

a housing;

a catch structure on or coupled to the housing, the catch structure being actuatable between an inactive state and an activated state, and wherein the catch structure allows the actuation device to: (i) travel through the one or more non-target sleeve valve assemblies when the catch structure is in the inactive state; and (ii) seat in the target sleeve valve assembly when the catch structure is in the activated state;

a first sensor operable for detecting, for each non-target sleeve valve assembly, a first detectable feature associated with the non-target sleeve valve assembly;

a second sensor operable for detecting, for each non-target sleeve valve assembly, a second detectable feature associated with the non-target sleeve valve assembly; and a controller, operatively coupled to the first and second sensors, configured to increase a sleeve valve assembly count value responsive to detecting the first detectable feature and the second detectable feature within a predetermined time window, wherein the second detectable feature is different from the first detectable feature.

2. The actuation device of claim 1, wherein the device further comprises an actuator coupled to the catch structure, and the controller is further configured to actuate the catch structure, via the actuator, to the activated state when the sleeve valve assembly count value reaches a pre-determined threshold.

3. The actuation device of claim 1, further comprising a power supply, wherein the controller is further configured to selectively power the second sensor responsive to detecting of the first detectable feature.

4. The actuation device of claim 1, wherein detecting the first detectable feature comprises the first sensor generating first sensor output responsive to the first detectable feature, and detecting the second detectable feature comprises the second sensor generating second sensor output responsive to the second detectable feature, and the first and second sensor outputs are received by the controller.

5. The actuation device of claim 4, wherein the controller is further configured to:

generate a first timestamp responsive to receipt of the first sensor output, and generate a second timestamp responsive to receipt of the second sensor output, and compare the first time stamp and the second timestamp to determine whether the second sensor output was received by the controller within the predetermined time window.

6. The actuation device of claim 1, wherein:

the first sensor comprises a magnetometer, a RFID reader, an optical sensor, an acoustic sensor, a radiation detector, or combinations thereof; and the second sensor comprises an impact sensor.

7. The actuation device of claim 6, wherein the first sensor comprises the magnetometer.

8. The actuation device of claim 1, wherein:

the first sensor comprises an impact sensor; and the second sensor comprises a magnetometer, a RFID reader, an optical sensor, an acoustic sensor, a radiation detector, or combinations thereof.

9. The actuation device of claim 8, wherein the second sensor comprises the magnetometer.

10. An actuation device, comprising:

a housing;

a catch structure on or coupled to the housing, the catch structure being actuatable between an inactive state and an activated state, and wherein the catch structure allows the actuation device to: (i) travel through one or more non-target sleeve valve assemblies when the catch structure is in the inactive state; and (ii) seat in a target sleeve valve assembly when the catch structure is in the activated state;

a first sensor operable for detecting, for each non-target sleeve valve assembly, a first detectable feature associated with the non-target sleeve valve assembly;

a second sensor operable for detecting, for each non-target sleeve valve assembly, a second detectable feature associated with the non-target sleeve valve assembly; and a controller, operatively coupled to the first and second sensors, configured to detect, using the first sensor, the first detectable feature;

detect, using the second sensor, the second detectable feature; and increase a sleeve valve assembly count value in response to detecting the first detectable feature and the second detectable feature within a predetermined time window, wherein the second detectable feature is different from the first detectable feature.

11. The actuation device of claim 10, further comprising an actuator coupled to the catch structure, wherein the controller is further configures to control the actuator to actuate the catch structure to the activated state when the sleeve valve assembly count value reaches a pre-determined threshold.

12. The actuation device of claim 10, wherein the controller is further configured to provide power to the second sensor responsive to detecting the first detectable feature.

13. The actuation device of claim 10, wherein the controller is further configured to:

receive first sensor output from the first sensor, the first sensor output being responsive to the first detectable feature, and receive second sensor output from the second sensor, the second sensor output being responsive to the second detectable feature.

14. The actuation device of claim 13, wherein the controller is configured to:

generate a first timestamp responsive to receipt of the first sensor output;

generate a second timestamp responsive to receipt of the second sensor output; and compare the first timestamp and second timestamp to determine whether the second sensor output was received by the controller within the predetermined time window.

15. The actuation device of claim 10, wherein:

the first sensor comprises a magnetometer, a RFID reader, an optical sensor, an acoustic sensor, a radiation detector, and combinations thereof; and the second sensor comprises an impact sensor.

16. The actuation device of claim 15, wherein the first sensor comprises the magnetometer.

17. The actuation device of claim 10, wherein:

the first sensor comprises an impact sensor; and the second sensor comprises a magnetometer, a RFID reader, an optical sensor, an acoustic sensor, a radiation detector, or combinations thereof.

18. The actuation device of claim 17, wherein the second sensor comprises the magnetometer.

19. A controller for an actuation device comprising a catch structure actuatable between an inactive state and an activated state, a first sensor, and a second sensor, the catch structure allowing the actuation device to (i) travel through one or more non-target sleeve valve assemblies in a wellbore tubing string when the catch structure is in the inactive state, and (ii) seat in a target sleeve valve assembly when the catch structure is in the activated state, the controller comprising:

a processor, memory having stored thereon processor executable instructions that, when executed by the processor, cause the processor to:

detect, for each non-target sleeve valve assembly and using the first sensor, a first detectable feature associated with the non-target sleeve valve assembly;

detect, for each non-target sleeve valve assembly using the second sensor, a second detectable feature associated with the non-target sleeve valve assembly; and increase a sleeve valve assembly count value responsive to detecting the first detectable feature and the second detectable feature within a predetermined time window, wherein the second detectable feature is different from the first detectable feature.

20. The controller of claim 19, wherein the device further comprises an actuator coupled to the catch structure, and the method further comprises controlling the actuator to actuate the catch structure to the activated state when the sleeve valve assembly count value reaches a pre-determined threshold.

21. An actuation device for actuating a target sleeve valve assembly of a plurality of sleeve valve assemblies in a wellbore tubing string, the plurality of sleeve assemblies including one or more non-target sleeve valve assemblies uphole of the target sleeve valve assembly, the actuation device comprising:

a housing;

a catch structure on or coupled to the housing, the catch structure being actuatable between an inactive state and an activated state, and wherein the catch structure allows the actuation device to: (i) travel through the one or more non-target sleeve valve assemblies when the catch structure is in the inactive state; and (ii) seat in the target sleeve valve assembly when the catch structure is in the activated state;

a first sensor operable for detecting, for each non-target sleeve valve assembly, a first detectable feature associated with the non-target sleeve valve assembly;

a second sensor operable for detecting, for each non-target sleeve valve assembly, a second detectable feature associated with the non-target sleeve valve assembly;

a controller, operatively coupled to the first and second sensors, configured to increase a sleeve valve assembly count value responsive to detection of the first detectable feature and the second detectable feature within a predetermined time window; and a power supply, wherein the controller selectively powers the second sensor responsive to detecting of the first detectable feature.

22. An actuation device for actuating a target sleeve valve assembly of a plurality of sleeve valve assemblies in a wellbore tubing string, the plurality of sleeve assemblies including one or more non-target sleeve valve assemblies uphole of the target sleeve valve assembly, the actuation device comprising:

a housing;

a catch structure on or coupled to the housing, the catch structure being actuatable between an inactive state and an activated state, and wherein the catch structure allows the actuation device to: (i) travel through the one or more non-target sleeve valve assemblies when the catch structure is in the inactive state; and (ii) seat in the target sleeve valve assembly when the catch structure is in the activated state;

a first sensor configured to detect, for each non-target sleeve valve assembly, a first detectable feature associated with the non-target sleeve valve assembly and generate a first sensor output associated with detecting the first detectable feature;

a second sensor configured to detect, for each non-target sleeve valve assembly, a second detectable feature associated with the non-target sleeve valve assembly and generate a second sensor output associated with detecting the first detectable feature;

a controller, operatively coupled to the first and second sensors, configured to:

receive the first sensor output;

receive the second sensor output;

generate a first timestamp responsive to receiving the first sensor output;

generate a second timestamp responsive to receiving the second sensor output;

compare the first time stamp and the second timestamp to determine whether the second sensor output was received by the controller within the predetermined time window; and increase a sleeve valve assembly count value responsive to determining the first sensor output and the second sensor output were received within a predetermined time window.

23. An actuation device, comprising:

a housing;

a catch structure on or coupled to the housing, the catch structure being actuatable between an inactive state and an activated state, and wherein the catch structure allows the actuation device to: (i) travel through one or more non-target sleeve valve assemblies when the catch structure is in the inactive state; and (ii) seat in a target sleeve valve assembly when the catch structure is in the activated state;

a first sensor operable for detecting, for each non-target sleeve valve assembly, a first detectable feature associated with the non-target sleeve valve assembly;

a second sensor operable for detecting, for each non-target sleeve valve assembly, a second detectable feature associated with the non-target sleeve valve assembly; and a controller, operatively coupled to the first and second sensors, configured to:

detect, using the first sensor, the first detectable feature;

powering the second sensor responsive to detecting the first detectable feature;

detect, using the second sensor, the second detectable feature; and increase a sleeve valve assembly count value in response to detecting the first detectable feature and the second detectable feature within a predetermined time window.

24. An actuation device, comprising:

a housing;

a catch structure on or coupled to the housing, the catch structure being actuatable between an inactive state and an activated state, and wherein the catch structure allows the actuation device to: (i) travel through one or more non-target sleeve valve assemblies when the catch structure is in the inactive state; and (ii) seat in a target sleeve valve assembly when the catch structure is in the activated state;

a first sensor operable for detecting, for each non-target sleeve valve assembly, a first detectable feature associated with the non-target sleeve valve assembly;

a second sensor operable for detecting, for each non-target sleeve valve assembly, a second detectable feature associated with the non-target sleeve valve assembly; and a controller, operatively coupled to the first and second sensors, configured to:

detect, using the first sensor, the first detectable feature by receiving first sensor output from the first sensor associated with the first detectable feature;

detect, using the second sensor, the second detectable feature by receiving second sensor output from the second sensor associated with the second detectable feature;

generate a first timestamp responsive to receipt of the first sensor output;

generate a second timestamp responsive to receipt of the second sensor output;

compare the first and second timestamps to determine whether the second sensor output was received within a predetermined time window;

increase a sleeve valve assembly count value in response to determining that the first sensor output and the second sensor output was received within the predetermined time window.

25. A controller, comprising:

a processor, memory having stored thereon processor executable instructions that, when executed by the processor, cause the processor to:

detect, for each non-target sleeve valve assembly in a wellbore tubing string and using the first sensor, a first detectable feature associated with the non-target sleeve valve assembly;

detect, for each non-target sleeve valve assembly in the wellbore tubing string and using the first sensor using the second sensor, a second detectable feature different from the first detectable feature and associated with the non-target sleeve valve assembly; and increase a sleeve valve assembly count value responsive to detecting the first detectable feature and the second detectable feature within a predetermined time window.

* * * * *